US007932832B2

(12) United States Patent
Hayashi

(10) Patent No.: US 7,932,832 B2
(45) Date of Patent: Apr. 26, 2011

(54) MOVEMENT MANAGING SYSTEM

(75) Inventor: Hitoshi Hayashi, Tokyo (JP)

(73) Assignee: IHC Corporation, Tokyo (JP)

( * ) Notice: Subject to any disclaimer, the term of this patent is extended or adjusted under 35 U.S.C. 154(b) by 573 days.

(21) Appl. No.: 11/579,862

(22) PCT Filed: May 10, 2005

(86) PCT No.: PCT/JP2005/008492

§ 371 (c)(1),
(2), (4) Date: Jul. 31, 2008

(87) PCT Pub. No.: WO2005/109365

PCT Pub. Date: Nov. 17, 2005

(65) Prior Publication Data

US 2009/0009338 A1 Jan. 8, 2009

(30) Foreign Application Priority Data

May 11, 2004 (JP) ..... 2004-141531

(51) Int. Cl.
*G08B 1/08* (2006.01)

(52) U.S. Cl. ..... 340/573.1; 340/539.13; 340/5.82

(58) Field of Classification Search ..... 340/573.1, 340/573.4, 539.13, 539.16, 5.6, 5.8–5.84, 340/825.36

See application file for complete search history.

(56) References Cited

U.S. PATENT DOCUMENTS

| | | | | |
|---|---|---|---|---|
| 6,437,696 | B1 * | 8/2002 | Lemelson et al. | 340/573.4 |
| 6,674,368 | B2 * | 1/2004 | Hawkins et al. | 340/573.4 |
| 6,998,985 | B2 * | 2/2006 | Reisman et al. | 340/573.1 |
| 7,126,470 | B2 * | 10/2006 | Clift et al. | 340/539.13 |
| 7,365,645 | B2 * | 4/2008 | Heinze et al. | 340/572.1 |
| 7,619,533 | B2 * | 11/2009 | Crucilla | 340/573.4 |
| 2002/0196147 | A1 * | 12/2002 | Lau | 340/573.1 |
| 2003/0044046 | A1 * | 3/2003 | Nakamura et al. | 382/103 |
| 2003/0197612 | A1 * | 10/2003 | Tanaka et al. | 340/572.1 |
| 2004/0066276 | A1 * | 4/2004 | Gile et al. | 340/5.53 |
| 2005/0029346 | A1 * | 2/2005 | Byrne et al. | 235/382 |

FOREIGN PATENT DOCUMENTS

| | | |
|---|---|---|
| JP | 8-190684 | 7/1996 |
| JP | 9-326092 | 12/1997 |
| JP | 11-167688 | 6/1999 |
| JP | 2003-35473 | 2/2000 |
| JP | 2002-163760 | 6/2002 |

(Continued)

*Primary Examiner* — Eric M Blount

(74) *Attorney, Agent, or Firm* — Kratz, Quintos & Hanson, LLP

(57) ABSTRACT

To provide a movement managing system for grasping the movement of a remote person and acquiring the information with improved reliability. A movement managing system for managing the movement of a person to be managed comprises a personal information input device (10) installed on a movement path of the person, a data managing server (20) for managing information on the person, and information acquiring device (30) for acquiring information on the person from the data managing server. When personal information for specifying the person is inputted, the personal information input device (10) transmits the personal information and the device ID that the device (10) uniquely has to the data managing server (20). The data managing server (20) identifies the pass position on the movement path that the person has passed on the basis of the personal information and device ID received from the personal information input device (10) and transmits information representing the pass position that the person has passed to the information acquiring device (30).

26 Claims, 17 Drawing Sheets

FOREIGN PATENT DOCUMENTS

| | | |
|---|---|---|
| JP | 2002-304448 | 10/2002 |
| JP | 2003-16487 | 1/2003 |
| JP | 2003-179912 | 6/2003 |
| JP | 2003-223508 | 8/2003 |

* cited by examiner

Fig.2

| DEVICE ID | LATITUDE AND LONGITUDE | ADDRESS | INSTALLED POSITION OF DEVICE |
|---|---|---|---|
| 0001 | EAST LONGITUDE ○○°○○′<br>NORTH LATITUDE △△°△△′ | SHINJUKU-KU XXX 1-1-1 ,TOKYO | IN FRONT OF ○○ BUILDING |
| 0002 | EAST LONGITUDE ○○°○○′<br>NORTH LATITUDE △△°△△′ | SHINJUKU-KU XXX 1-2-3 ,TOKYO | xx INTERSECTION |
| 0003 | EAST LONGITUDE ○○°○○′<br>NORTH LATITUDE △△°△△′ | SHINJUKU-KU XXX 2-1-1 ,TOKYO | IN SUPERMARKET |
| 0004 | EAST LONGITUDE ○○°○○′<br>NORTH LATITUDE △△°△△′ | SHINJUKU-KU XXX 3-4-1 ,TOKYO | ▲▲ ELEMENTARY SCHOOL GATE |
| ⋮ | ⋮ | ⋮ | ⋮ |

Fig.4

| TERMINAL ID | PREDETERMINED TIME |
|---|---|
| 0001 | |
| ↓ | 1 |
| 0003 | |
| ↓ | 2 |
| 0011 | |
| ↓ | 3 |
| 0004 | |
| ↓ | 1 |
| 0022 | |
| ↓ | 2 |
| 0087 | |
| TOTAL | 9 |

Fig.6

| TERMINAL ID | PREDETERMINED PASS TIME | ACTUAL PASS TIME |
|---|---|---|
| 0001 | 08:03 | 08:03 |
| 0003 | 08:04 | 08:06 |
| 0011 | 08:06 | 08:07 |
| 0004 | 08:09 | |
| 0022 | 08:10 | |
| 0087 | 08:12 | |

Fig.9

| BIOMETRICS INFORMATION | MESSAGE |
|---|---|
| RIGHT-EYE IRIS | I'LL GO TO FRIEND'S HOME AND THEN COME HOME |
| LEFT-EYE IRIS | I'LL COME HOME LATE FOR CLUB |
| TOUCH CONTINUOUSLY WITH PALM THREE TIMES | I'LL DIRECTLY GO TO JUKU (AFTER-HOURS CRAM SCHOOL) |
| TOUCH CONTINUOUSLY WITH PALM FIVE TIMES | I'LL PLAY AND THEN COME HOME |

Fig.16

| DEVICE ID | LATITUDE AND LONGITUDE | ADDRESS | TYPE OF MEANS OF TRANSPORTATION | INSTALLED POSITION OF DEVICE |
|---|---|---|---|---|
| 0011 | EAST LONGITUDE○○°○○′<br>NORTH LATITUDE△△°△△′ | SINJUKU-KUxxx5−1−1,TOKYO | ○○ RAILWAY | XX STATION |
| 0012 | EAST LONGITUDE○○°○○′<br>NORTH LATITUDE△△°△△′ | SINJUKU-KUxxx5−1−1,TOKYO | ●● RAILWAY | XX STATION |
| 0013 | EAST LONGITUDE○○°○○′<br>NORTH LATITUDE△△°△△′ | | △△ BUS | BUS VEHICLE |
| 0014 | EAST LONGITUDE○○°○○′<br>NORTH LATITUDE△△°△△′ | SINJUKU-Kuxxx3−4−4,TOKYO | △△ BUS | ▲▲ BUS STOP |
| ⋮ | ⋮ | ⋮ | ⋮ | ⋮ |

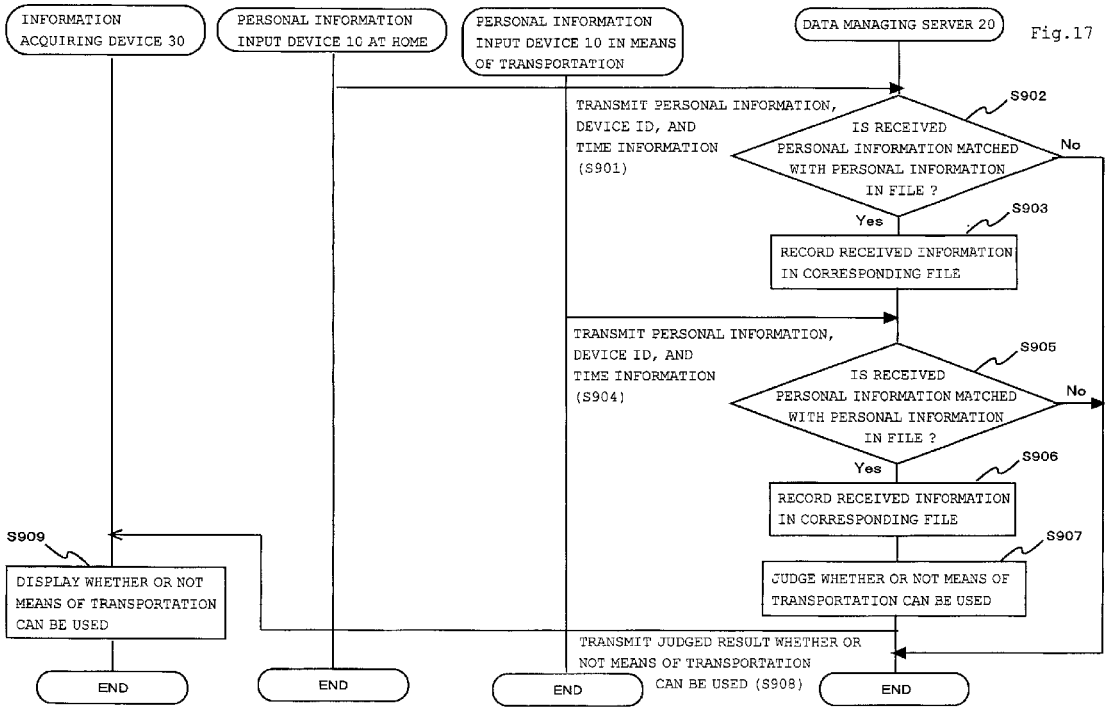
INFORMATION ACQUIRING DEVICE 30
PERSONAL INFORMATION INPUT DEVICE 10 AT HOME
PERSONAL INFORMATION INPUT DEVICE 10 IN MEANS OF TRANSPORTATION
DATA MANAGING SERVER 20
Fig.17
TRANSMIT PERSONAL INFORMATION, DEVICE ID, AND TIME INFORMATION (S901)
S902
IS RECEIVED PERSONAL INFORMATION MATCHED WITH PERSONAL INFORMATION IN FILE ?
No
Yes
S903
RECORD RECEIVED INFORMATION IN CORRESPONDING FILE
TRANSMIT PERSONAL INFORMATION, DEVICE ID, AND TIME INFORMATION (S904)
S905
IS RECEIVED PERSONAL INFORMATION MATCHED WITH PERSONAL INFORMATION IN FILE ?
No
Yes
S906
RECORD RECEIVED INFORMATION IN CORRESPONDING FILE
S907
JUDGE WHETHER OR NOT MEANS OF TRANSPORTATION CAN BE USED
S909
DISPLAY WHETHER OR NOT MEANS OF TRANSPORTATION CAN BE USED
TRANSMIT JUDGED RESULT WHETHER OR NOT MEANS OF TRANSPORTATION CAN BE USED (S908)
END
END
END
END

MOVEMENT MANAGING SYSTEM

TECHNICAL FIELD

The present invention relates to a movement managing system. More specifically, the present invention relates to a movement managing system which collects and manages movement information on a person to be managed via a network.

BACKGROUND ART

These days the rate of crime against children is steadily increasing with deteriorated social security. Actually, parents cannot look after their children going to and from school and are difficult to grasp all movements of their children.

The number of families of elderly people who live alone or elderly couples is increasing from the social background with nuclear families. Such elderly people who live alone suddenly get sick, which cannot be found immediately, resulting in a serious situation.

Many families have desired to grasp the contents of movement of their children or elderly people in the area in which they cannot be looked after.

Conventionally, families contacted by their children or elderly people who are not at home by public telephone or cellular phone checked their current state.

There are also systems for checking the position of a child or an elderly person carrying a cellular phone having a GPS (Global Positioning System) function and a system in which a family can browse a camera image installed in a day nursery on a terminal.

As one prior art for checking the position of a remote person, there are a security system and a cellular phone with an emergency contact function disclosed in Patent Document 1.

In Patent Document 1, when the emergency button of the cellular phone having the GPS function is depressed, its current state is transmitted to a server and the server then transmits the received position information on the cellular phone to a terminal device to be contacted.

Patent Document 1: Japanese Patent Laid-Open No. 2004-40733

DISCLOSURE OF THE INVENTION

Problems to be Solved by the Invention

The following problems have arisen in the prior art.

(1) When a person to be managed such as a child is busy, it can be difficult for the person to make contact with his/her family by cellular phone or public telephone.

(2) A cellular phone can be difficult to be carried by a student all the time because it is not allowed to be brought into school by the school rules and is left or stolen.

(3) Whether the cellular phone is being actually held by the person to be managed cannot be confirmed.

The present invention has been made in view of the foregoing problems and an object of the present invention is to provide a movement managing system for grasping the movement of a remote person and acquiring the information with improved reliability.

Means for Solving the Problems

To achieve such object, a movement managing system of the present invention for managing the movement of a person to be managed has personal information input devices installed in plural specified positions and inputting personal information on the person, a data managing server for managing information on the person, and an information acquiring device for acquiring information on the person from the data managing server, wherein when personal information for specifying the person is inputted, the personal information input device transmits the personal information and the device ID that the device uniquely has to the data managing server, wherein the data managing server identifies the pass position on the movement path that the person has passed on the basis of the personal information and device ID received from the personal information input device, and transmits the identified information to the information acquiring device.

According to the movement managing system of the present invention, the data managing server previously stores the personal information, checks the stored personal information with the received personal information, and identifies the person to be managed.

According to the movement managing system of the present invention, the data managing server receives personal information on the person to be managed from the personal information input device in the position out of a predetermined movement path of the person previously stored in itself, and transmits information that the person is moving out of the estimated movement path to the information acquiring device.

According to the movement managing system of the present invention, the data managing server stores a table representing message information corresponding to the personal information, receives the personal information from the personal information input device, refers to the table representing the message information to convert the received personal information to the message information, and transmits the converted message information to the information acquiring device.

According to the movement managing system of the present invention, the data managing server creates the message information on the basis of one of the type, the number of receptions, and the reception interval of personal information received from the personal information input device or a combination of these, and transmits the created message information to the information acquiring device.

According to the movement managing system of the present invention, the data managing server stores a table representing the correspondence of the device ID and the installed position of the personal information input device, and identifies the installed position corresponding to the received device ID as the pass position on the movement path.

According to the movement managing system of the present invention, the personal information input device transmits time information representing a time in which the personal information is inputted to the data managing server together with the personal information and the device ID, and the data managing server transmits the time information received from the personal information input device as a time in which the person has passed the installed position of the personal information input device to the information acquiring device together with information representing the pass position.

According to the movement managing system of the present invention, the data managing server stores a predetermined movement time information representing a time required for the person to be managed to move on the movement path, estimates a pass time or arrival time on the movement path that the person has passed using the predetermined movement time information, and transmits information representing the estimated time to the information acquiring device together with information representing time in which the person has actually passed or arrived.

According to the movement managing system of the present invention, the data managing server transmits information that the person to be managed has not passed or arrived to the information acquiring device when the pass or arrival estimated time has elapsed while the person has not passed or arrived.

According to the movement managing system of the present invention, the data managing server stores a table representing position information corresponding to the personal information, receives the personal information and the device ID from the personal information input device, refers to the table representing the position information to convert the received personal information to information representing the movement destination of the person to be managed, identifies the current position of the person from the device ID, and estimates the movement path of the person from the movement destination and the current position.

According to the movement managing system of the present invention, the data managing server receives personal information on the person to be managed from the personal information input device out of the estimated movement path, and transmits information that the person is moving out of the estimated movement path to the information acquiring device.

According to the movement managing system of the present invention, when a fixed time or more has elapsed since personal information on the same person to be managed has not been received from the personal information input device, the data managing server transmits information that an abnormality is caused to the input of the personal information to the information acquiring device.

According to the movement managing system of the present invention, the data managing server continuously receives personal information on the same person to be managed from the personal information input device over a predetermined number of times within a predetermined time, and transmits information that an abnormality is caused to the input of the personal information to the information acquiring device.

According to the movement managing system of the present invention, the data managing server transmits age information on the person to be managed identified on the basis of personal information received from the personal information input device to the information acquiring device.

According to the movement managing system of the present invention, the data managing server judges whether or not a person identified by the personal information can enter a predetermined facility on the basis of personal information received from the personal information input device, and transmits information representing the judged result whether or not the person can enter the facility to the personal information input device, and the personal information input device controls unlocking and locking of the entrance to the predetermined facility on the basis of the judged result whether or not the person can enter the facility received from the data managing server.

According to the present invention, the person to be managed is a child going to and from school, and plural personal information input devices are installed in the school zone.

According to the present invention, the person to be managed is an elderly person, and one or more personal information input devices are installed in the home of the elderly person.

According to the present invention, the person to be managed is a missing person, the movement managing system further has a search organization terminal operated by a search organization searching for the person, and the data managing server transmits information representing the installed position of the personal information input device on the transmitting side to the search organization terminal when the person identified on the basis of personal information received from the personal information input device is registered as a missing person.

According to the present invention, the person to be managed is a beneficiary receiving a service and a service provider providing the service to the beneficiary, and the data managing server judges that the beneficiary and the service provider identified by personal information received from the personal information input device are in the service use-provision relation, and, records information that the service provision by the service provider has started or ended in itself, upon reception of personal information on the both.

According to the present invention, the person to be managed is a beneficiary receiving a nursing care service and a nursing care service provider providing a nursing care service to the beneficiary, and the data managing server judges that the beneficiary and the nursing care service provider identified by personal information received from the personal information input device are in the nursing care service use-provision relation, and records that the nursing care service provision by the nursing care service provider has started or ended in itself, upon reception of personal information on the both.

According to the movement managing system of the present invention, the data managing server transmits information on the identification card of the person to be managed identified on the basis of personal information received from the personal information input device to the information acquiring device.

According to the present invention, information on the identification card is information on a car license, passport, residents' basic register card, employee identification card, and student identification card.

According to the present invention, the person to be managed is an insured person, the personal information input device is installed in a medical facility, and when personal information on the person to be managed is inputted, transmits the inputted personal information to the data managing server, and the data managing server judges that a person identified by personal information received from the personal information input device is an insured person of an insurance available in the medical facility, and transmits information on the insured person previously stored in itself so as to be matched with the personal information to the information acquiring device installed in the medical facility.

According to the present invention, the person to be managed is a user of the book lending service in a library, the personal information input device is installed in the library and when personal information on the person to be managed is inputted, transmits the inputted personal information to the data managing server, and the data managing server judges that the person identified by the personal information received from the personal information input device can borrow a book from the library and transmits information that the book can be lent to the information acquiring device installed in the library.

According to the movement managing system of the present invention, the data managing server stores information representing a means of transportation available by the person to be managed, judges whether or not the person identified on the basis of personal information received from the personal information input device can use the means of transportation in which the personal information input device on the transmitting side is installed, and transmits the judged result to the information acquiring device installed in the means of transportation.

According to the movement managing system of the present invention, the person to be managed is a person receiving free-of-charge/discount application for an elderly person using a means of transportation, the personal information input device is installed at the boarding gate or the ticket gate of the means of transportation and when personal information on the person to be managed is inputted, transmits the inputted personal information to the data managing server, and the data managing server stores the personal information so as to be matched with information representing whether or not free-of-charge/discount can be applied, refers to the stored information to judge whether or not the person identified by the personal information received from the personal information input device is a person having a qualification for free-of-charge/discount application, and transmits information representing the judged result to the information acquiring device.

According to the movement managing system of the present invention, the personal information is biometrics information on the person to be managed.

In an arbitrary combination of the above components and the components and expression of the present invention, methods, devices, systems, computer programs, and recording media storing computer programs are replaced with each other. This is effective as the embodiments of the present invention.

Effect of the Invention

The movement managing system of the present invention for managing the movement of a person to be managed has a personal information input device installed on the movement path of the person, a data managing server for managing information on the person, and an information acquiring device for acquiring information on the person from the data managing server, wherein when personal information for specifying the person is inputted, the personal information input device transmits the personal information and the device ID that the device uniquely has to the data managing server, wherein the data managing server identifies the pass position on the movement path that the person has passed on the basis of the personal information and device ID received from the personal information input device and transmits information representing the pass position that the person has passed to the information acquiring device. Therefore, the movement managing system can grasp the movement of a remote person and acquire the information with improved reliability.

BEST MODE FOR CARRYING OUT THE INVENTION

<Basic Configuration>

FIG. 1 is a diagram showing the configuration of a movement managing system according to an embodiment of the present invention. The configuration of the movement managing system will be described below using the drawing.

The movement managing system has one or more personal information input devices 10 installed on the movement path (within the range of movement) of a person to be managed such as a child and inputting personal information on the person to be managed, a data managing server 20 for creating the movement history of the person to be managed on the basis of personal information inputted from the personal information input device 10, an information acquiring device 30 for acquiring the movement history of the person to be managed from the data managing server 20, and a network 100.

The personal information input device 10, the data managing server 20, and the information acquiring device 30 are connected via the network 100.

The personal information input device 10 is an information input device installed and managed by a data managing company for managing the movement of a specified person according to a request from the family of children or elderly people.

As described above, one or more personal information input devices 10 are installed on the movement path of the person to be managed. The person to be managed inputs his/her own personal information to the personal information input devices 10 installed at the points the person has passed.

The device IDs that the devices uniquely have are assigned to the personal information input devices, respectively. When personal information is inputted, the personal information input device 10 transmits the personal information, information representing the installed position of the personal information input device 10, and current time to the data managing server 20.

Preferably, the personal information input device 10 has the function of reading biometrics information. Here, the biometrics information read by the personal information input device 10 may be one of a fingerprint, an iris, a venous pattern, the feature of a face, strength of key touching, a voiceprint, the shape of a palm, a temperature image, or a combination of these. For instance, the person to be managed touches the read portion of the personal information input device 10 with his/her palm to input biometrics information such as a venous pattern to the personal information input device 10.

The data managing server 20 is an information processing device managed by the data managing company and is, e.g., a high end PC such as a workstation.

The data managing server 20 manages and stores personal information on each person to be managed by each personal record file.

The data managing server 20 checks the personal information stored in the personal record file with the personal information received from the personal information input device 10 to identify the person of the personal information.

After identifying the person, the data managing server 20 writes time and position information received from the personal information input device 10 to the movement history of the identified person of the movement histories of one or more persons stored in itself.

The data managing server 20 previously stores a table showing the correspondence of the device ID with the installed position of the personal information input device 10.

FIG. 2 is a diagram showing an example of a table showing the correspondence of the devices ID and the installed positions of the personal information input devices 10. As shown in the drawing, in the table, terminal IDs, latitude and longitude information on the installed positions of the personal information input devices 10, address information, and the features of the peripheries of the positions correspond with each other.

The data managing server 20 refers to the table to create information representing the movement state of the person to be managed and transmits it to the information acquiring device 30. The transmitted information represents, e.g., the contents: "The person to be managed has passed ▲▲ intersection at 15:10".

The information acquiring device 30 is an information processing device operated by a person who desires to grasp the movement of the person to be managed (the family of the person to be managed) and may be a mobile data terminal such as a cellular phone, PHS, or PDA, various PCs such as a tower PC, desktop PC, or notebook PC, or various electronic devices having a connection function to the network 100.

In the first to fifteenth embodiments described below, unless otherwise specified, the movement managing system is of the configuration described using the drawing. In addition, unless otherwise specified, the components indicated by the same reference numerals have similar configurations and functions.

First Embodiment

The operation of the movement managing system according to a first embodiment will be described below.

In this embodiment, the person to be managed is a child, and personal information inputted to the personal information input device 10 is biometrics information on the child.

(Movement Managing Operation of the Child Going to School)

FIG. 3 is a sequence chart showing the flow of the movement managing operation of the child going to school according to the movement managing system. The movement managing operation of the child going to and from school will be described below along the drawing.

Immediately before going to school, the child inputs biometrics information to the personal information input device 10 installed in his/her home (step S101).

The personal information input device 10 transmits the inputted biometrics information, the device ID that the device uniquely has, and current time information to the data managing server 20 (step S102).

The data managing server 20 receives the transmitted information from the personal information input device 10 and checks the received biometrics information with the biometrics information stored in itself (step S103).

After the check, the data managing server 20 judges that the biometrics information matched with the received biometrics information is stored in itself, and writes time in which the information is inputted so as to be matched with the device ID of the personal information input device 10 to which the information is inputted to the personal record file of the person to be managed of the matched biometrics information (step S104).

The child leaves home to move to school as a destination. The child inputs the biometrics information to the personal information input device 10 installed on the path to the school.

The information inputting, transmitting, checking, and writing operations until the child arrives at the destination are repeated in steps S101 to S104.

Finally, when the child arrives at the school as a destination, he/she inputs the biometrics information to the personal information input device 10 installed near its gate before entering it (step S105).

The personal information input device 10 transmits the inputted biometrics information, the device ID of the personal information input device 10 installed near the gate, and current time information to the data managing server 20 (step S106).

The data managing server 20 checks the biometrics information received from the personal information input device 10 near the gate (step S107), and writes the biometrics information, the device ID, and the current time information received from the personal information input device 10 to the personal record file of the person to be managed matched with the biometrics information (step S108).

The data managing server 20 transmits information that the child has arrived at the destination to the information acquiring device 30 operated by the parents of the child by e-mail (step S109). Hereinafter, such information representing the movement state of the child such as arrival will be called movement state information.

The information acquiring device 30 displays the information that the child has arrived at the destination (step S110).

The parents of the child browse the screen of the information acquiring device 30 to check that the child has arrived at the destination safely.

The movement managing operation of the child going to school is described above. The movement managing system can perform the same movement managing operation as that of the child going home from school.

When the child returns home, the data managing server 20 receives the biometrics information from the personal information input device 10 at home and transmits information that the child has arrived home safely to the information acquiring device 30 installed in the school by e-mail.

The information acquiring device 30 installed in the school displays the information that the child has returned home. A school staff such as a teacher browses the screen of the information acquiring device 30 to check that the child has returned home safely.

In this embodiment, the personal information inputted to the personal information input device 10 is biometrics information. Personal information written onto a recording medium such as an IC card may be inputted to the personal information input device 10.

The data managing server 20 may write the type of the personal information received from the personal information input device 10 such as a fingerprint, iris, or IC card to the corresponding personal record file.

The data managing server 20 may record the personal information received from the personal information input device 10 to a personal record file.

The data managing server 20 may transmit and notify the checked result to the personal information input device 10 for each input of personal information. In this case, the personal information input device 10 has the function of displaying or notifying the checked result and may display "○" when the personal information is matched and "x" when the personal information cannot be read or is not matched with the registered information.

When the checked result displays "x", the person to be managed inputs the personal information again so that the movement history created in the personal record file can be reliable.

The personal information input device 10 at the start point of the person to be managed such as his/her home may be integral with the information acquiring device 30. The personal information input device 10 may be a portable communication terminal.

As described above, in this embodiment, the data managing server 20 checks the personal information input at the destination and transmits information that the person to be managed has arrived at the destination to the information acquiring device 30.

In addition to arrival, each time the data managing server 20 receives and checks personal information from the personal information input devices 10 installed in the positions other than the start point, it may notify movement state information representing that the person to be managed has passed the points to the information acquiring device 30 by e-mail.

The data managing server 20 may previously record the device ID of the personal information input device 10 installed on the movement path (the range of movement) of the person to be managed in each personal record file.

In this case, when the data managing server 20 receives personal information from the personal information input device 10 installed out of the movement path, it may transmit alarm message information that the person to be managed is moving out of the movement path to the information acquiring device 30 by e-mail. The information acquiring device 30 receives the alarm message information and displays the contents of the message on the displayed screen. Upon reception of the alarm message information, the data managing server 20 may give an alarm sound.

The person concerned with the person to be managed can easily grasp unexpected movement of the person to be managed and can prevent the person to be managed from being involved in an accident or crime.

Here, the data managing server 20 previously stores the device ID on the movement path. The device ID on the movement path may be detected as follows. The person to be managed inputs a destination using the personal information input device 10. The data managing server 20 receives the information representing the destination and the device ID (that is, the current position) of the personal information input device 10 on the inputting side of the information, and searches for the movement path from the destination and the current position. The data managing server 20 detects the device ID of the personal information input device 10 installed on the searched path with reference to the table shown in FIG. 2.

(Identifying Operation at a Destination)

The movement managing system may decide whether or not the person to be managed such as a child is allowed to enter a facility at a destination.

In this case, which facility the person to be managed is allowed to enter is previously recorded in the personal record file of the data managing server 20.

By way of example, the identifying operation of the child arriving at school as a destination and entering the ground of the school will be described.

The child arrives at school as a destination and inputs personal information such as biometrics information to the personal information input device 10 installed at the school gate. The personal information input device 10 transmits the inputted personal information and the device ID that the device uniquely has to the data managing server 20.

The data managing server 20 checks the personal information received from the personal information input device 10 with the personal information previously stored in itself. When both are matched with each other, the data managing server 20 judges whether or not the person to be managed is allowed to enter the school in the personal record file of the corresponding person to be managed. When the person is allowed to enter the school, the data managing sever 20 transmits information that the gate is unlocked to the personal information input device 10 installed at the gate. The personal information input device 10 receives the information that the gate is unlocked and controls the gate to open so that the child can enter the school.

When the personal information received from the personal information input device 10 and the personal information previously stored in the data managing server 20 are not matched with each other or the person to be managed is not allowed to enter the school, the data managing server 20 transmits information that the gate remains closed or an alarm is given to the personal information input device 10. The personal information input device 10 gives an alarm according to the information.

When the person to be managed inputs personal information to the personal information input device 10 at the destination, the data managing server 20 notifies information that the person to be managed has arrived at the destination to the information acquiring device 30 and judges whether or not the person to be managed is allowed to enter the destination. Therefore, it is possible to prevent any suspicious person from entering each facility. The personal information input device 10 may be installed at the door of each room in the school. The data managing server 20 may judge whether or not the person to be managed is allowed to enter each room.

The denial regarding the entrance can be suitably changed according to time in which everyone is allowed to enter the school on Sundays or only staffs are allowed to enter the school at night.

The identifying operation of the child entering the school is described above. Needless to say, the movement managing system is applicable when a different person enters other facilities.

Second Embodiment

A second embodiment will be described below. In this embodiment, as in the first embodiment, the person to be managed is a child, and personal information inputted to the personal information input device 10 is biometrics information on the child.

(Pass/Arrival Time Managing Operation)

In the first embodiment, the data managing server 20 notifies movement state information that the person to be managed has passed each point and has arrived at the destination on the movement path to the information acquiring devices 30 on the start point side and the destination side by e-mail.

In this embodiment, when the child goes to and from school, the data managing server 20 notifies the movement state information including a predetermined time in which the child passes the points in the school zone and a time in which the child has actually passed the points to the parents of the child and the school.

The notifying operation of such state of the child going to and from school according to the movement managing system will be described.

The data managing server 20 previously stores information representing a time required for the person to be managed to move on the movement path (hereinafter, predetermined movement time information) in each personal record file. FIG. 4 is a diagram showing an example of the predetermined movement time information.

As shown in the drawing, the data managing server 20 stores as the predetermined movement time information a path of each movement and a predetermined time required for movement between the points (including the start point and destination) on the movement path.

The drawing shows an example in which personal information is inputted to the personal information input devices 10 installed on the movement path in the order of the devices IDs of "0001"→"0003"→"0011"→"0004"→"0022"→"0087". The drawing shows that it takes "one minute", "two minutes", "three minutes", "one minute", and "two minutes" respectively when the person to be managed moves between the terminals so that nine minutes are required from the start point to the destination.

FIG. 5 is a flowchart showing the flow of the notifying operation of the movement state of the child going to and from school.

The data managing server 20 receives biometrics information, the device ID, and time information from the personal information input device 10 installed at the start point such as the child's home (step S201) and checks the biometrics information (step S202).

The data managing server 20 judges that biometrics information matched with the received biometrics information is stored in itself (step S202/Yes), refers to the above predetermined movement time information in the personal record file of the corresponding person to be managed, and calculates a predetermined pass time at the points on the path (step S203).

The data managing server 20 receives the biometrics information, the device ID, and time information from another personal information input device 10 on the path (step S204). The biometrics information is matched with the biometrics information stored in itself (step S205/Yes). The data managing server 20 creates movement state information representing the calculated predetermined pass time and an actual pass time (step S206). The data managing server 20 transmits it to the information acquiring devices 30 at the start point and the destination by e-mail (step S207).

The data managing server 20 repeats the operation of steps S204 to S207 until the child arrives at the destination. Each time the data managing server 20 receives information from each personal information input device 10 on the path, it writes the actual pass time, creates information representing the pass state on the path of the child, and transmits it to the information acquiring devices 30 at the start point and the destination.

The information acquiring device 30 displays the received movement state information. The family of the child and school browse the movement state information displayed on the information acquiring device 30 to check whether or not the child is moving in the school zone as expected. FIG. 6 is a diagram showing an example of the movement state information.

In this example, the data managing server 20 calculates a predetermined pass time in the installed positions of the personal information input device 10 other than the start point on the basis of the above predetermined movement time information, as a start point, "8:03" as time in which the biometrics information is inputted to the personal information input device 10 with the device ID "0001" at the start point.

For example, in the example shown in FIG. 4, a time required from the personal information input device 10 with the device ID "0001" to the personal information input device 10 with the device ID "0003" is "one minute". The predetermined pass time in the installed position of the personal information input device 10 with the device ID "0003" is calculated as "8:04" or "one minute" after "8:03".

The child's family checks information as shown in FIG. 6 and judges whether or not the child is going to school safely.

The data managing server 20 notifies the movement state information to the information acquiring device 30 of the parents of the child (the start point) and may notify it to the information acquiring device 30 at the destination such as the school. For instance, the data managing server 20 may transmit information representing the predetermined arrival time to the destination to the information acquiring device 30 when the child starts.

The destination, e.g., the school staff can easily check delay of the child going to school and can immediately cope with any trouble such as an accident or crime caused to the child.

The data managing server 20 may fixedly record the predetermined movement time information in the personal record file or may calculate an average value of the time required for the child to actually move to dynamically rewrite the predetermined movement time information in the personal record file. The data managing server 20 may dynamically rewrite the predetermined movement time information to the latest time required for actual movement.

In the above example, the data managing server 20 notifies the movement state information to the information acquiring devices 30 at the start point and the destination each time the child has passed the points on the movement path. When time in which the child has actually passed or arrived at the points is later than the predetermined time by a fixed time or more, the movement state information (or an alarm message of delay) may be transmitted to the information acquiring device 30.

As described above, the data managing server 20 notifies time in which the child has actually passed the points on the path together with the predetermined pass time to the information acquiring devices 30 at home and the school. When not being contacted by the child, the home and the school can grasp the detailed movement state of the child.

Third Embodiment

A third embodiment will be described below. In this embodiment, as in the first embodiment, the person to be managed is a child.

(Movement Managing Operation of the Child Moving to Plural Destinations)

In the above-described embodiments, the movement managing operation of the child moving to one destination is described.

The movement managing operation of the child moving to plural destinations will be described below. Here, by way of example, the movement managing operation of the child visiting his/her friend's home and then moving to juku (after-hours cram school) will be described.

As described above, when the child moves to one destination, the data managing server 20 notifies information that the child has passed the points on the path and has arrived at the destination and a pass time to the information acquiring devices 30 at the start point and the destination by e-mail.

When the child moves to the final destination via one or more destinations in the order of home→friend's home→ . . . →juku, the data managing server 20 notifies information representing that the child has passed the points on the path and has arrived at the destination to the information acquiring device 30 at the passed destination (that is, friend's home) as well as to the information acquiring devices 30 at the start point and the destination (that is, home and juku) by e-mail.

The data managing server 20 notifies information representing the predetermined pass time of the points on the path, the actual pass time, the predetermined arrival time to another destination, and the actual arrival time to the information acquiring device 30 at the passed destination by e-mail.

When the child moves to the final destination via one or more destinations, the movement state of the child is notified to the information acquiring devices 30 at the start point and the final destination and also to the information acquiring device 30 at the passed destination (friend's home). The child's home, the friend's home, and the juku can check the movement state of the child and can obtain relief. When any crime or accident is caused to the child, they can immediately cope with it.

Fourth Embodiment

A fourth embodiment will be described below. In this embodiment, as in the first embodiment, the person to be managed is a child, and personal information inputted to the personal information input device 10 is biometrics information on the child.

(Person Searching Operation)

In this embodiment, the movement managing system is used for searching for a missing person.

FIG. 7 is a diagram showing the configuration of a movement managing system of this embodiment.

As shown in the drawing, the movement managing system of this embodiment has the configuration of the first to third embodiments and a search organization terminal 40 connected to the network 100.

The search organization terminal 40 is an information processing device operated by the staff of a search organization searching for a missing person (e.g., police) and a mobile communication terminal such as a cellular phone, PHS, PDA, or various PCs such as a notebook PC, tower PC, or desktop PC.

The staff of the search organization uses the search organization terminal 40 to check the movement contents of the missing person for searching for the missing person. FIG. 8 is a flowchart showing the flow of the searching operation of the missing person according to the movement managing system. It will be described below along the drawing.

The person concerned with the missing person uses the information acquiring device 30 to ask the search organization to search for the missing person.

The search organization receives the request and uses the search organization terminal 40 to register the missing person to the data managing server 20.

The data managing server 20 receives the registered request and writes "missing" information to the corresponding personal record file (step S301).

The data managing server 20 receives the personal information from the personal information input device 10 (step S302/Yes), checks the received personal information with the personal information in the personal record file (step S303), and nudges whether or not the matched personal information belongs to the currently "missing" person (step S304).

The data managing server 20 judges that the matched personal information belongs to the currently "missing" person (step S304/Yes), and extracts personal data (name, feature, etc.) of the corresponding person from the corresponding personal record file (step S305).

The data managing server 20 refers to the database stored in itself and extracts the address matched with the device ID on the transmitting side of the personal information (step S306).

The data managing server 20 transmits various pieces of information such as the extracted personal data and an address to the search organization terminal 40 (step S307). The search organization terminal 40 receives the information, and the search organization uses the information such as the feature and address to search for or secure the missing person.

As described above, the search organization uses the movement managing system to easily search for a kidnapped missing person, a lost child, and an elderly person.

For instance, a kidnapped person inputs personal information to the peripheral personal information input device 10 by avoiding the eye of the criminal. The search organization can identify the location of the person.

The search organization requests an unspecified number of people with the similar age and physical feature as those of the missing person to input personal information using the personal information input device 10 to identify the location of the missing person. The search organization checks the movement of the person rejecting the request as a person to be watched. The possibility of realizing early finding of the missing person can be high.

Fifth Embodiment

A fifth embodiment will be described below.

In this embodiment, the type and the number of inputs of personal information inputted to the personal information input device 10 are previously stored in each personal record file of the data managing server 20 so as to be matched with a message. The personal information input device 10 is used for communication.

FIG. 9 is a diagram showing an example of the correspondence of inputted personal information and messages.

In the example shown in the drawing, when "right-eye iris information" is inputted as personal information to the personal information input device 10, the message will be: "I'll go to my friend's home and then come home" and when "left-eye iris information" is inputted, the message will be: "I'll come home late for club". A different message is matched with the inputted personal information according to its type.

In the example of the drawing, when the child continuously touches a sensor provided in the personal information input device 10 with palm three times, the message will be: "I'll directly go to juku" and when the child continuously touches it with palm five times, the message will be: "I'll play and then come home". A different message is matched with the inputted personal information according to the number of inputs thereof.

FIG. 10 is a flowchart showing the flow of the transmitting operation of the messages by the data managing server 20. The transmitting operation of the messages will be described below along the drawing.

The data managing server 20 receives personal information and the corresponding device ID from the personal information input device 10 (step S401/Yes), checks the received personal information with the personal information in the personal record file (step S402), and judges whether or not the type and the number of times of inputs of the matched personal information are matched with the message in the personal record file (step S403).

The data managing server 20 judges that the matched information is matched with the corresponding message in the personal record file (step S403/Yes), extracts the message (step S404), and transmits the extracted message to the previously set information acquiring device 30 on the transmitted side (step S405).

Personal information such as biometrics information is inputted to the personal information input device 10. The message can be transmitted to the previously set information acquiring device 30 on the transmitted side. When the child does not carry a communication device such as a cellular phone when he/she is not at home, he/she can easily communicate with the other party. For instance, many schools do not allow students to carry a cellular phone so that the utility is high.

In this embodiment, the data managing server 20 extracts the message matched with the personal information and transmits the message to the transmitted side. The message is stacked in the data managing server 20, and upon reception of an acquisition request from the corresponding information acquiring device 30, the data managing server 20 may extract the message in which the acquisition requesting side is the transmitted side to send it back to the information acquiring device 30.

The transmitted side of the message may be different according to the type and the number of times of personal information to be inputted. In this case, a person inputting personal information can transmit a message to plural transmitted sides.

The data managing server 20 judges that the movement destination of the person to be managed is included in the message extracted on the basis of personal information and can search the movement path of the person from the destination and the current position of the person to be managed detected from the device ID.

In this case, as described above, alarm message information is transmitted to the information acquiring device 30 when the person to be managed moves out of the movement path. The person concerned with the person to be managed can easily grasp unexpected movement of the person to be managed.

Sixth Embodiment

In this embodiment, the person to be managed is a person who requires nursing care such as an elderly person or a sick person, and personal information inputted to the personal information input device 10 is preferably biometrics information on the person.

In this embodiment, a data managing company installs the personal information input device 10 in the life area of the person to be managed. Here, by way of example, it is installed near the bathroom and bed in the home of the person to be managed. For instance, the personal information input device 10 having an iris reading function may be installed around the bathroom and bed. Alternatively, the personal information input device 10 having a fingerprint reading function may be installed on the door knob of the bathroom. For instance, when the person to be managed gets up, he/she inputs personal information to the personal information input device 10 provided on the bed. The personal information input device 10 transmits the inputted personal information to the data managing server 20.

The data managing server 20 checks the personal information received from the personal information input device 10 with the personal information previously stored in each personal record file. When the personal information matched with the received personal information is recorded in the personal record file, input time of the personal information and the inputted device ID of the personal information input device 10 are recorded in the personal record file of the corresponding person.

The person to be managed goes to the bathroom and inputs personal information to the personal information input device 10 provided in the bathroom.

Each time input of the personal information is repeated, the data managing server 20 writes the input time of the personal information and the device ID to the personal record file of the corresponding person to create the input history of the personal information.

The family of the person to be managed makes the inquiry to the data managing server 20 using the information acquiring device 30 and acquires the input history of the personal information on the person to be managed from the data managing server 20.

While the personal information is inputted, it is possible to check that the person to be managed is alive or safe. The movement managing system according to this embodiment can be applied to a person who leaves for his/her new post alone without his/her family and a person who lives alone. The safety of the person to be managed can be easily checked.

Seventh Embodiment

In this embodiment, as in the sixth embodiment, the person to be managed is a person requiring nursing care such as an elderly person or sick person, and personal information inputted to the personal information input device 10 is preferably biometrics information on the person.

In this embodiment, the movement managing system immediately asks for help from the third party when sudden illness, emergency state, or a difficult state requiring help is caused to the person to be managed. The operation of the movement managing system will be described below. The personal information input device 10 may be installed around a bed or a bathroom, as in the sixth embodiment. When sudden sick, an emergency state, or a difficult state arises, the person to be managed inputs personal information to the personal information input device 10. Preferably, the personal information is biometrics information (e.g., a vein pattern such as a finger). In this case, the person to be managed can input the personal information easily and immediately.

The personal information input device 10 transmits the inputted personal information, the device ID that the device uniquely has, and current time information to the data managing server 20.

The data managing server 20 checks the personal information received from the personal information input device 10 with the personal information previously stored in the personal record file. When the personal information matched with the received personal information is recorded in the personal record file, the data managing server 20 writes the input time of the personal information and the device ID to the personal record file. The data managing server 20 may write the received personal information itself and the type of the personal information.

The data managing server 20 receives the personal information and recognizes that an emergency state is caused to the person to be managed corresponding to the personal information in a location identified by the device ID. The data managing server 20 transmits information that the emergency state is caused to the information acquiring device 30 installed in each organization concerned such as the emergency services, police, a regional health nurse, or a care worker by e-mail.

As the notification method to each organization concerned, there are telephone contacts using an automatic voice system and alarm contact to the staff on duty in addition to e-mail.

The staff of the organization concerned visits the home of the person to be managed and checks his/her state to perform necessary help.

As described above, when an emergency state is caused, the person to be managed inputs personal information to the personal information input device 10. The data managing server 20 can identify the person and location in which the emergency state is caused and notifies the contents to each organization concerned. The organization concerned can immediately cope with the caused emergency state. Preferably, the type of personal information representing that an emergency state is caused is previously set. In this case, the person's movement managing function in another embodiment can be used together.

Eighth Embodiment

In this embodiment, as in the sixth embodiment, the person to be managed is a person requiring nursing care such as an elderly person or sick person, and personal information inputted to the personal information input device 10 is preferably biometrics information on the person.

In this embodiment, when personal information is not inputted for a long time, the data managing server 20 judges that an abnormality is caused to the person to be managed and transmits the information to the previously set information acquiring device 30 on the transmitted side by e-mail.

The operation of the movement managing system according to this embodiment will be described below.

As in the sixth embodiment, the data managing server 20 performs check upon reception of various pieces of information from the personal information input device 10 and writes the information to the corresponding personal record file.

The data managing server 20 judges whether or not a previously set time or more has elapsed since no input of personal information from a person to be managed in the movement history creating operation.

The data managing server 20 judges that the set time or more has not elapsed, it continues writing operation to the movement history.

On the other hand, the data managing server 20 judges that the set time or more has elapsed, it recognizes that some abnormality is caused to the person to be managed identified from the previously received personal information. The data managing server 20 transmits the information that the emergency state is caused to the information acquiring device 30 installed in each organization concerned such as the emergency services, police, a regional health nurse, or a care worker by e-mail. As the notification method to each organization concerned, there are telephone contacts using an automatic voice system and alarm contact to the staff on duty in addition to e-mail.

The staff of the organization concerned visits the home of the person to be managed and checks his/her state to perform necessary help.

As described above, the data managing server 20 judges that an emergency state is caused to the person to be managed who inputs no personal information for a fixed time or more and notifies the information to the organization concerned. Each organization concerned can immediately cope with the caused emergency state.

Ninth Embodiment

In this embodiment, as in the sixth embodiment, the person to be managed is a person requiring nursing care such as an elderly person or sick person, and personal information inputted to the personal information input device 10 is preferably biometrics information on the person.

In this embodiment, the data managing server 20 judges that an abnormality is caused to the person to be managed when personal information is inputted plural times for a short time, and transmits the information to the previously set information acquiring device 30 on the transmitted side by e-mail.

When the same person to be managed inputs personal information plural times, typically, the input interval is at least tens of seconds to several minutes. For instance, when the data managing server 20 continuously receives the personal information ten times or more every five seconds from the same person to be managed, it is apparent that some abnormality is caused to the transmitting side (the personal information input device 10 or the person to be managed).

The data managing server 20 performs check upon reception of various pieces of information from the personal information input device 10 and writes the information to the corresponding personal record file. When the data managing server 20 receives personal information from the same person to be managed a predetermined number of times or more in a fixed period or continuously receives personal information at a predetermined interval from the same person to be managed over a predetermined number of times, it judges that an abnormality is caused to the person to be managed or the personal information input device 10 on the transmitting side.

The data managing server 20 transmits information that an abnormality is caused to the information acquiring device 30 installed in each organization concerned or each company such as the emergency services, police, a regional health nurse, or a care worker, or the staff maintaining the personal information input device 10 to give an alarm sound, notifying the information.

As described above, when personal information is inputted by the same person to be managed a predetermined number of times or more for a short time, the data managing server 20 judges that an abnormality is caused to the person to be managed or the personal information input device 10 on the transmitting side and notifies the information to the organization concerned. Each organization concerned can immediately cope with the caused abnormal state.

Tenth Embodiment

In this embodiment, the person to be managed is a beneficiary receiving nursing care such as an elderly person or sick person or a nursing care service provider actually providing the nursing care service, and personal information inputted to the personal information input device 10 is preferably biometrics information on the person. The personal information input device 10 is installed in the home of the beneficiary.

In this embodiment, the data managing server 20 decides the start time and the end time of the nursing care service by the nursing care service provider on the basis of personal information and current time information from the beneficiary and the nursing care service provider and prevents incorrect charging of nursing care expenses by the nursing care service provider.

The operation of the movement managing system of this embodiment will be described below.

In this embodiment, the data managing server 20 previously stores personal information on the beneficiary and the nursing care service provider in each personal record files.

The data managing server 20 stores the personal information on the beneficiary so as to be matched with the personal information on the nursing care service provider in charge of nursing care of the beneficiary.

The data managing server 20 may store the personal information on the beneficiary so as to be matched with the personal information on all employees working for the company providing nursing care service to the beneficiary. The data managing server 20 stores the nursing care service use history of each beneficiary. The nursing care service use history shows the start time and the end time of the nursing care service and a nursing care service provider in charge of nursing care.

FIG. 11 is a sequence chart showing the flow of the operation of the movement managing system according to this embodiment. It will be described below along the drawing. The nursing care service provider visits the home of the beneficiary.

When the nursing care service provider starts nursing care service, the beneficiary inputs his/her own personal information to the personal information input device 10. The personal information input device 10 transmits the inputted personal information, the current time information, and the device ID that the device uniquely has to the data managing server 20 (step S501).

The nursing care service provider inputs his/her personal information to the personal information input device 10. The personal information input device 10 transmits the inputted personal information, the current time information, and the device ID that the device uniquely has to the data managing server 20 (step S502).

Here, the data managing server 20 checks the received personal information on the beneficiary and the received personal information on the nursing care service provider and judges whether or not they are matched with each other and are received within a predetermined time (step S503). The data managing server 20 judges that the personal information on the beneficiary and the personal information on the care service provider received within the predetermined time are matched with each other (step S503/Yes). The data managing server 20 writes the time information received in step S502 as the start time of nursing care service to the nursing care service use history of the beneficiary together with the name of the nursing care service provider in charge of the nursing care (step S504).

When service provision by the nursing care service provider is completed, the beneficiary inputs his/her own personal information to the personal information input device 10. The personal information input device 10 transmits the inputted personal information, the current time information, and the device ID that the device uniquely has to the data managing server 20 (step S505).

The nursing care service provider inputs his/her personal information to the personal information input device 10. The personal information input device 10 transmits the inputted personal information, the current time information, and the device ID that the device uniquely has to the data managing server 20 (step S506).

The data managing server 20 checks the received personal information on the beneficiary and the received personal information on the nursing care service provider and judges whether or not they are matched with each other and are received within a predetermined time (step S507).

The data managing server 20 judges that the personal information on the beneficiary and the personal information on the nursing care service provider received within the predetermined time are matched with each other (step S507/Yes). The data managing server 20 writes the time information received in step S506 as the end time of the nursing care service to the nursing care service use history of the beneficiary together with the name of the nursing care service provider in charge of nursing care (step S508).

When the personal information from the beneficiary and the personal information from the nursing care service provider are inputted, the data managing server 20 recognizes the start and end time of the nursing care service to create the nursing care service use history. Therefore, it is possible to prevent incorrectness of the nursing care service provider.

At the start and end of the nursing care service, the data managing company checks with the beneficiary as well as the nursing care service provider therefor and provides the nursing care service use history according to charging from an insurance organization paying a nursing care fee. Therefore, it is possible to prevent falsification of time and the number of times of the nursing care service provided by the nursing care service provider and incorrect contents.

The data managing server 20 may calculate, from the start and end time of the nursing care service, an average execution time of the nursing care service by all nursing care companies and an average execution time of the nursing care service of each nursing care company or each nursing care service provider and judge that an average value different by a fixed value or more from the entire average execution time (in particular, nursing care time longer than a fixed time) as an abnormal value.

The insurance organization paying a nursing care fee intensively investigates incorrect charging of the nursing care company or the nursing care service provider with an abnormal value and can efficiently grasp incorrectness at providing nursing care service.

The insurance organization may judge that the nursing care company or the nursing care service provider with the average execution time shorter than the entire average execution time as a good company and select the company preferentially. The insurance organization advises the nursing care company or the nursing care service provider with the abnormal value and can provide better nursing care service to the beneficiary.

In this embodiment, the movement managing system applied to the field of nursing care service is described above. The movement managing system can be applied to service in other fields. For instance, the service provider may be a babysitter, a person repairing or maintaining equipment such as a PC, and a tutor. In this case, the beneficiary may be a child, a person having equipment, and a student. As in the nursing care service, the data managing server 20 checks input of personal information by both the service provider and the beneficiary and records the start or end of service in itself. It is possible to prevent falsification of time and the number of times of service provided by the service provider and incorrect contents.

Eleventh Embodiment

In this embodiment, the movement managing system is used for checking the age of a person.

The age checking operation of the movement managing system according to this embodiment will be described below.

In this embodiment, the data managing server 20 matches age data of each person to be managed (birthday information may be included) with personal information on the person to previously store it in each personal record file.

In this embodiment, the personal information input device 10 is integral with the information acquiring device 30. Namely, the personal information input device 10 of this embodiment has the function of acquiring and displaying information from the data managing server 20. For instance, the personal information input device 10 is installed in a facility requiring age check.

For instance, when the personal information input device 10 is installed in a facility in which a fee is different according to age, such as a movie theater, the person to be managed enters the facility and inputs his/her personal information to the personal information input device 10. The personal information input device 10 transmits the inputted personal information to the data managing server 20 to request to acquire age data.

The data managing server 20 receives the personal information, extracts the personal information matched with the received personal information from the personal record file, and further extracts age data matched with the extracted personal information. The data managing server 20 transmits the extracted age data to the personal information input device 10 on the requesting side.

The personal information input device 10 displays the age data received from the data managing server 20. The employee of the facility checks the displayed age and charges the person to be managed for a fee according to the checked age using the facility.

As described above, the employee of the facility can check the age of the user (person to be managed) and can easily provide a service and charge the user for the fee according to the age of the user.

This embodiment can be applied under the following conditions.

1) Judgment of child and adult fares of a means of transportation
2) Judgment of sections of elementary school, junior high school, high school, college student, adult, and an elderly person for an admission fee or a service charge (examples: the charge system of a barber shop, the charge system of a buffet style restaurant, a liquor or cigarette vending machine, age limited movie, publication, page browsing on the Internet)
3) Admission limited by age (examples: late-night karaoke box, a movie theater, a coffee house with a comic-book library, Internet cafe, and a bar)
4) Identification and age check at admonishment
5) Checking for service provision (free-of-charge and half price) on a birthday and in a birth month

Twelfth Embodiment

In this embodiment, the movement managing system is used as identification for using a hospital instead of an insurance certificate. The configuration and operation of the movement managing system according to this embodiment will be described.

In this embodiment, the data managing server 20 stores personal information on each person to be managed so as to be matched with information necessary for identification (hereinafter, identification information) in each personal record file.

In this embodiment, the personal information input device 10 and the information acquiring device 30 are installed in a hospital.

FIG. 12 is a sequence chart showing the flow of the operation of the movement managing system according to this embodiment. It will be described below along the diagram. The person to be managed visits a medical facility such as a hospital and inputs his/her own personal information to the personal information input device 10 installed at the reception window of the medical facility. The personal information input device 10 transmits the inputted personal information, current time information, and the device ID that the device uniquely has to the data managing server 20 (step S601).

The staff of the medical facility uses the information acquiring device 30 to transmit information that the insured state of the person to be managed is required to the data managing server 20 (step S602).

The data managing server 20 receives the inputted personal information from the personal information input device 10 and checks the received personal information with the personal information stored in the personal record file (step S603).

The data managing server 20 judges that the received personal information is matched with the personal information stored in the personal record file (step S603/Yes), writes the received personal information, the device ID, and time information in which the personal information is inputted to the personal record file in which the matched personal information is stored (step S604), and extracts basic data of the insurance certificate such as an insurance number written to the personal record file (step S605).

The data managing server 20 creates reply data that the person to be managed is identified (step S606) and transmits it to the information acquiring device 30 specified as the transmitted side (step S607).

The reply data may include basic data of the extracted insurance certificate.

When the received personal information is not matched with the personal information stored in the personal record file (step S603/No), the data managing server 20 transmits a message that the person to be managed cannot be identified to the information acquiring device 30.

The information acquiring device 30 displays the contents of the reply data. The medical facility checks the displayed information whether or not the person to be managed is the insured and insurance number and studies the medical conditions of the person.

As described above, in this embodiment, the data managing server 20 checks the personal information inputted by the person to be managed and notifies the checked result and the insurance number to the medical facility. Therefore, it is possible to prevent plural persons from using the insurance certificate incorrectly.

When one insurance certificate is used by plural persons such as a family, information on the family who can use the insurance certificate may be associated with the personal record file in the data managing server 20.

In this embodiment, the identifying operation of the movement managing system when the person to be managed visits the medical facility is described above. Needless to say, it can be applied when the person to be managed visits other facilities.

The data managing server 20 stores personal information on the person to be managed so as to be matched with information necessary for identification.

In this case, the reply data includes a message that the person to be managed is identified: "You are identified as ○○", information such as the certificate number of the person and a password for using the medical facility, and a signal notifying the available state.

The employee of the facility decides the charge of the person to be managed according to the contents of the reply data and provides a service.

According to this embodiment, when personal information on the person to be managed is inputted to the personal information input device 10, the data managing server 20 transmits reply data identifying the person to be managed to the information acquiring device 30. The person to be managed who does not carry the insurance certificate can be immediately identified and can easily use the service according to the identification.

Thirteenth Embodiment

In this embodiment, the person to be managed is a person borrowing a book from a library. The personal information input device 10 and the information acquiring device 30 are installed in the library.

FIG. 13 is a sequence chart showing the flow of the operation of the movement managing system according to this embodiment. It will be described below along the drawing. The person to be managed visits the library and inputs personal information to the personal information input device 10 at the lending reception window of the library. The personal information input device 10 transmits the inputted personal information, the device ID, and current time information to the data managing server 20 (step S701).

The data managing server 20 checks the personal information (step S702). When the received personal information is matched with the personal information recorded in the personal record file (step S702/Yes), the data managing server 20 identifies the person to be managed.

The data managing server 20 writes the received personal information, the device ID, and time information in which the personal information is inputted to the personal record file in which the matched personal information is stored (step S703).

The data managing server 20 refers to the personal record file of the identified person to be managed, judges whether or not the book can be lent to the person to be managed (step S704), and transmits the information whether or not the book can be lent to the information acquiring device 30 (step S705).

When the received personal information is not matched with the personal information in the personal record file (step S702/No), in step S705, the data managing server 20 transmits information that the book cannot be lent to the information acquiring device 30.

The information acquiring device 30 displays the information whether or not the book can be lent. The library checks the displayed contents and lends the book to the person to be managed.

As described above, in this embodiment, the data managing server 20 checks the personal information inputted by the person to be managed and notifies whether or not the book can be lent to the library. Therefore, it is possible to prevent incorrect borrowing by pretending to be the other. The person to be managed who does not bring a library card necessary for book lending can use the lending service. The data managing server 20 may have the function of managing book lending. In this case, the data managing server 20 may transmit information representing the lent state of the person to be managed matched with the personal information to the information acquiring device 30.

An electronic medium such as an IC tag for crime prevention may be attached to a book. The information acquiring device 30 receives information that the book can be lent from the data managing server 20, and inputs the lendable information to the electronic medium attached to the book.

A sensor is installed at the entrance to the library. When an electronic medium to which no lendable information is inputted passes the entrance to the library, an alarm installed in the library gives an alarm that the book is taken out incorrectly.

This can prevent a book which has not been lent from being taken out incorrectly. When using this system, the person to be managed who borrows the book may operate the information acquiring device 30. Therefore, the number of staffs of the library can be reduced.

The movement managing system according to this embodiment can be applied to lending other articles as well as books and can also be applied to selling of articles.

Fourteenth Embodiment

In this embodiment, the person to be managed desires to use a facility to be used such as a hall.

FIG. 14 is a diagram showing the configuration of a movement managing system according to this embodiment.

As shown in the drawing, the movement managing system according to this embodiment has the personal information input device 10, the data managing server 20, and a locking device 50 connected to the network 100.

The locking device 50 locks and unlocks the entrance to the facility to be used and limits entrance thereto.

The personal information input device 10 is installed at the entrance to the facility to be used. The person to be managed inputs his/her own personal information to the personal information input device 10. When the personal information is previously registered in the data managing server 20, the locking device 50 unlocks the entrance to the facility to be used.

The operation of the movement managing system according to this embodiment will be described below.

FIG. 15 is a sequence chart showing the flow of the operation of the movement managing system according to this embodiment. It will be described below along the drawing. The person to be managed uses a terminal such as a PC or cellular phone, not shown, transmits information representing the facility to be used and the period for use to the data managing server 20, and registers it in his/her own personal record file (step S801).

The person to be managed visits the facility to be used and inputs his/her own personal information to the personal information input device 10 installed at its entrance before entering the facility to be used. The personal information input device 10 transmits the inputted personal information, the device ID, and current time information to the data managing server 20 (step S802). The data managing server 20 checks the personal information (step S803). When the received personal information is matched with the personal information recorded in the personal record file (step S803/Yes), the data managing server 20 identifies the person to be managed.

The data managing server 20 writes the received personal information, the device ID, and time information in which the personal information is inputted to the personal record file in which the matched personal information is stored (step S804).

The data managing server 20 transmits information that the entrance to the facility to be used is allowed to be unlocked to the locking device 50 (step S805).

The locking device 50 receives the information that the entrance is allowed to be unlocked, unlocks the entrance to the facility to be used (step S806), and allows entrance of the person to be managed.

After a fixed time has elapsed, the data managing server 20 transmits information that the entrance to the facility to be used is required to be locked to the locking device 50 (step S807). The locking device 50 locks the entrance according to the request (step S808).

As described above, in this embodiment, the data managing server 20 checks personal information inputted by the person to be managed and transmits information that the facility is allowed to be unlocked to the locking device 50 for limiting entrance to the facility to be used. Therefore, it is possible to prevent incorrect entrance to the facility to be used by pretending to be the other. It can be applied to the entrance to the home or the apartment of the person to be managed as well as the entrance to the facility to be used.

Fifteenth Embodiment

In this embodiment, the person to be managed desires to use a means of transportation such as a railway, bus, or airplane.

The personal information input device 10 is installed at the entrance or the ticket gate of a transporting vehicle (bus or train) of the means of transportation.

The person to be managed inputs his/her own personal information to the personal information input device 10. When the personal information is previously registered in the data managing server 20, the person to be managed can use the means of transportation under the use conditions written to the personal record file. The use conditions of the means of transportation such as the section and period for use are determined according to a fare which the person to be managed has paid to the means of transportation.

The operation of the movement managing system according to this embodiment will be described below.

The data managing server 20 stores the use conditions of the means of transportation used by the person to be managed in each personal record file. For instance, the use conditions include the contents of a commutation ticket or an airplane ticket of each person to be managed.

In this embodiment, the data managing server 20 stores a table showing the correspondence of the device ID of each personal information input device 10, the installed position, and information representing the type of the means of transportation in which the terminal is installed.

FIG. 16 is a diagram showing an example of the table.

In the example shown in the drawing, the data managing server 20 stores the terminal ID of each personal information input device 10, the address of the installed position, the type of the means of transportation in which the terminal is installed, and a facility or the means of transportation (station, bus stop, airport, and bus itself) in which the terminal is installed, which correspond with each other.

FIG. 17 is a sequence chart showing the flow of the operation of the movement managing system according to this embodiment. It will be described below along the drawing. Before using the means of transportation such as a railway or bus, the person to be managed inputs his/her own personal information using the personal information input device 10 installed in his/her home, for instance. The personal information input device 10 transmits the inputted personal information, the device ID, and current time information to the data managing server 20 (step S901). The data managing server 20 checks the personal information (step S902) and identifies the person to be managed when the received personal information is matched with the personal information recorded in the personal record file (step S902/Yes).

The data managing server 20 writes the received personal information, the device ID, and time information in which the personal information is inputted to the personal record file in which the matched personal information is stored (step S903).

The person to be managed moves to a station or bus stop and uses the means of transportation.

The person to be managed inputs his/her own personal information to the personal information input device 10 installed at the entrance or the ticket gate of the means of transportation to be used. The personal information input device 10 transmits the inputted personal information, the device ID, and current time information to the data managing server 20 (step S904).

When the personal information input device 10 is installed at which the position is not fixed in one position, such as a running bus, it transmits position information at input of the personal information acquired using GPS to the data managing server 20.

The data managing server 20 checks the personal information (step S905) and identifies the person to be managed when the received personal information is matched with the personal information recorded in the personal record file (step S905/Yes).

The data managing server 20 writes the received personal information, the device ID, and time information in which the personal information is inputted to the personal record file in which the matched personal information is stored (step S906).

The data managing server 20 receives the position information in which the personal information is inputted and writes the position information to the personal record file.

The data managing server 20 judges whether or not the person to be managed can use the means of transportation he/she desires to use from the type and the section for use of the means of transportation in the personal record file and the position identified by the device ID (or position information by GPS) (step S907) and transmits information representing the judged result to the previously specified information acquiring device 30 (step S908).

The information acquiring device 30 receives information whether or not the person to be managed can use the means of transportation from the data managing server 20 and displays information whether or not the person can use the means of transportation (step S909).

The staff of the means of transportation decides whether or not the person to be managed can use the means of transportation on the basis of the displayed contents of the information acquiring device 30.

The information acquiring device 30 may be interlocked with the automatic ticket gate of a train or airplane. In this case, the information acquiring device 30 transmits the judged result from the data managing server 20 to the automatic ticket gate. The automatic ticket gate receives the judged result that the person to be managed can use the means of transportation to allow the person to ride it, and receives the judged result that the person cannot use the means of transportation to refuse riding by closing the gate.

The movement managing system performs the same operation as riding (steps S904 to S909) when the person to be managed gets off the means of transportation.

Each time the data managing server 20 writes the use history of the means of transportation of the person to be managed to the personal record file or when the history is required to be browsed, it may transmit the written contents to the information acquiring device 30 operated by the family of the person to be managed by e-mail.

In this case, the family of the person to be managed can easily manage the movement of each person to be managed. As described above, according to this embodiment, when the person to be managed uses the means of transportation, the data managing server 20 judges whether or not the person to be managed can use the means of transportation on the basis of the received personal information and provides the judged result to the means of transportation. The means of transportation can prevent incorrect riding such as falsification of a commutation ticket or riding at no charge. The person to be managed can ride the means of transportation without bringing his/her commutation ticket.

Personal information on a suspicious person and a criminal and information whether or not the person to be managed is allowed to use the means of transportation are stored in the data managing server 20. It is possible to prevent movement, runaway and extraction of a suspicious person and a criminal.

SUMMARY OF THE EMBODIMENTS

In the above embodiments, the person to be managed inputs biometrics information to the personal information input device 10 as an example of personal information. Other inputting methods of the personal information may be used. For instance, a password may be inputted as personal information to the personal information input device 10.

A combination of a name, address, school name, and identification information may be inputted as personal information.

A recording medium such as an IC card may be brought into contact with the personal information input device 10 to input personal information in the recording medium. The person to be managed may carry an IC tag and automatically input personal information to the personal information input device 10 wirelessly when passing near the personal information input device 10.

The personal information input device 10 may be installed in a place of a highly public nature, specifically, a traffic light, mailbox, public telephone, the entrance to the facility of a public organization (school), bus stop, hospital, the entrance to a park, utility pole, streetlight, and the entrance to a banking facility.

The personal information input device 10 may be installed in a place many people pass, specifically, the ticket gate of a means of transportation such as a railway, the door of a means of transportation, the entrance to a commercial facility such as a station building, department store, and supermarket, and the entrance to an apartment.

The wall on a street, a utility pole, an address display plate attached to a building, and the button portion of a vending machine may be an information input portion (fingerprint sensor) of the personal information input device 10.

In particular, the button portion of a vending machine is the input portion of personal information. The person to be managed can input personal information without being conscious of it.

In the above embodiments, the personal information input device 10 is fixed in a specified place, but the personal information input device 10 itself may be a mobile communication terminal or may be installed on a mobile body.

For instance, as described above, the personal information input device 10 may be installed in moving means such as a train or may be a portable mobile data terminal such as a cellular phone, PHS, or PDA. In this case, the personal information input device 10 has the GPS function and transmits information representing inputted personal information on the person to be managed, current time, and information representing the current position of the device to the data managing server 20.

In the above embodiments, the personal information input device 10 transmits personal information inputted to the device to the data managing server 20. The data managing server 20 checks the personal information.

On the other hand, the personal information input device 10 itself stores a personal record file and may check personal information inputted to the device. In this case, the personal information input device 10 transmits the checked result, the time in which the personal information is inputted, and the device ID to the data managing server 20. The data managing server 20 records the received information as a movement history to its own personal record file.

The data managing server 20 may store a personal record file covering the entire school area or may store the whole of cities, towns, and villages, the whole of Japan, or the whole of the world for each area.

In the above embodiments, device IDs different from each other are assigned to the personal information input devices 10 to identify each personal information input devices 10.

Access locations (addresses) from each personal information input devices 10 to the data managing server 20 are different from each other to identify each personal information input devices 10.

The information acquiring device 30 may be installed at any of the start point, the relay point, and the destination on the movement path of the person to be managed.

In addition to the above embodiments, the movement managing system can be used for attendance check, work performance management, or identification of election voting. Personal information is inputted instead of showing the insurance certificate, library card, and other identification card such as a commutation ticket (for instance, a car license, passport, residents' basic register card, employee identification card, and student identification card), thereby using various services.

For instance, when the person to be managed is driving a car and is required to show the car license by a police officer, his/her personal information is inputted to the personal information input device 10 managed by the police officer. The data managing server 20 records in itself the input history of the personal information received from the personal information input device 10.

When the person to be managed enters or leaves the country, he/she may show his/her own personal information instead of showing the passport.

When the person to be managed enters a company, he/she may input his/her own personal information instead of showing the employee identification card. The data managing server 20 may receive the inputted personal information to perform authentication and judge whether the person to be managed can enter the company, to transmit the judged result to the terminal of the company.

The personal information input device 10, the data managing server 20, the information acquiring device 30, the sales manager terminal 40, and the movement managing system 50 are realized by a program loaded to mainly a CPU and a memory. A combination of arbitrary hardware and software can construct this device or a server. The high degree of freedom of design will be easily understood by those skilled in the art.

When the personal information input device 10, the data managing server 20, the information acquiring device 30, the sales manager terminal 40, and the movement managing system 50 are software modules, this program may be recorded onto a recording medium such as an optical recording medium, magnetic recording medium, magneto-optical recording medium, or recording medium such as a semiconductor, and may be loaded from the recording medium or be loaded from an external device connected via a predetermined network.

The above embodiments are only one example of preferred embodiments of the present invention. The embodiments of the present invention are not limited to these and can be modified and embodied in the scope without departing from the purport of the present invention.

BRIEF DESCRIPTION OF THE DRAWINGS

FIG. 2 is a diagram showing an example of a table showing the correspondence of device IDs and the installed positions of personal information input devices 10;

FIG. 4 is a diagram showing an example of predetermined movement time information;

FIG. 6 is a diagram showing an example of movement state information;

FIG. 9 is a diagram showing an example of the correspondence of inputted personal information and messages;

FIG. 16 is a diagram showing an example of a table showing the correspondence of the device IDs of the personal information input devices and means of transportation in which the devices are installed; and FIG. 17 is a sequence chart showing the flow of the operation according to the movement managing system.

EXPLANATION OF REFERENCE NUMERALS

Figure 1:
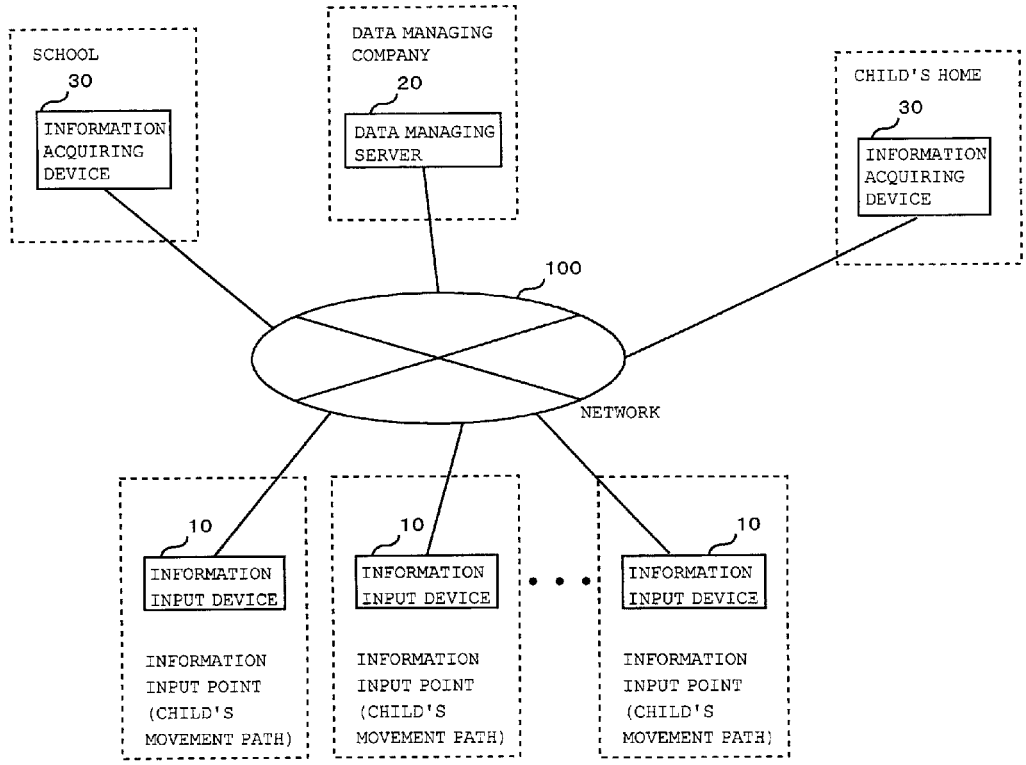
FIG. 1 is a diagram showing the configuration of a movement managing system.

10 Personal information input device
20 Data managing server
30 Information acquiring device
40 Search organization terminal
50 Locking device
100 Network FIG. 1
1 SCHOOL
2 INFORMATION ACQUIRING DEVICE
3 DATA MANAGING COMPANY
4 DATA MANAGING SERVER
5 CHILD'S HOME
6 INFORMATION ACQUIRING DEVICE
7 NETWORK
8 INFORMATION INPUT DEVICE
9 INFORMATION INPUT POINT (CHILD'S MOVEMENT PATH)

FIG. 2
1 DEVICE ID
LATITUDE AND LONGITUDE
ADDRESS
INSTALLED POSITION OF DEVICE
2 EAST LONGITUDE
NORTH LATITUDE
3 SHINJUKU-KU, TOKYO
4 IN FRONT OF ○○ BUILDING
xx INTERSECTION
IN SUPERMARKET
▲▲ ELEMENTARY SCHOOL GATE

Figure 3:
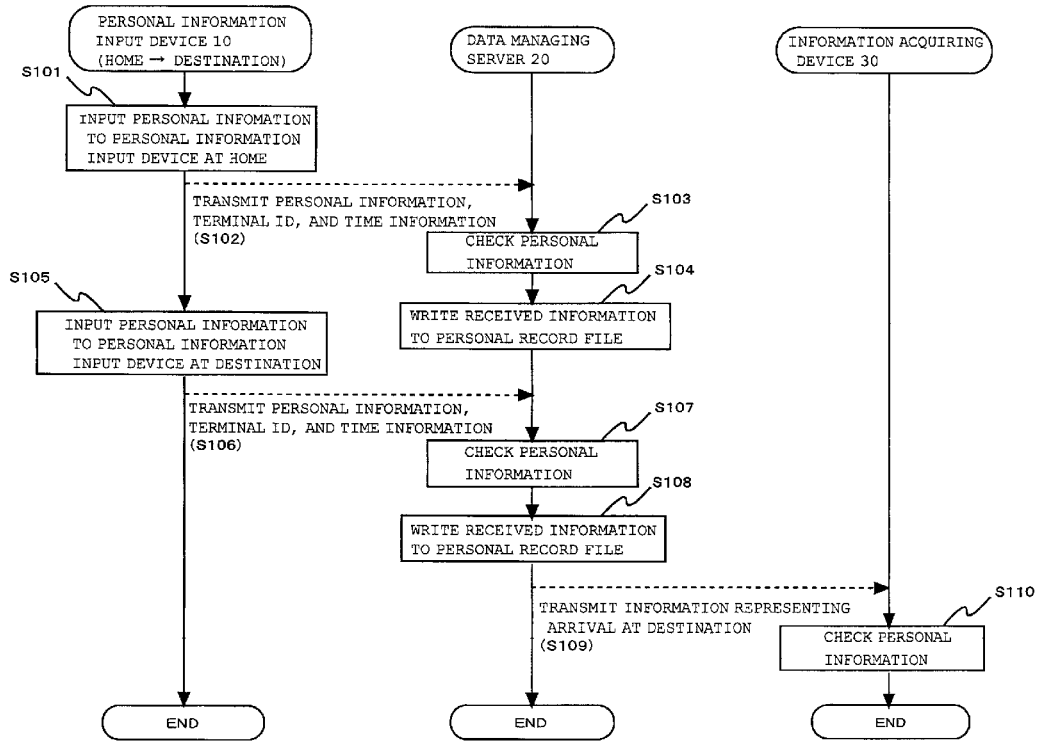
FIG. 3 is a sequence chart showing the flow of the movement managing operation of a child going to school according to the movement managing system.

FIG. 3
1 PERSONAL INFORMATION INPUT DEVICE 10 (HOME→DESTINATION)
2 INPUT PERSONAL INFORMATION TO PERSONAL INFORMATION INPUT DEVICE AT HOME
3 INPUT PERSONAL INFORMATION TO PERSONAL INFORMATION INPUT DEVICE AT DESTINATION
4 TRANSMIT PERSONAL INFORMATION, TERMINAL ID, AND TIME INFORMATION (S102)
5 TRANSMIT PERSONAL INFORMATION, TERMINAL ID, AND TIME INFORMATION (S106)
6 DATA MANAGING SERVER 20
7 CHECK PERSONAL INFORMATION
8 WRITE RECEIVED INFORMATION TO PERSONAL RECORD FILE
9 CHECK PERSONAL INFORMATION
10 WRITE RECEIVED INFORMATION TO PERSONAL RECORD FILE
11 TRANSMIT INFORMATION REPRESENTING ARRIVAL AT DESTINATION (S109)
12 INFORMATION ACQUIRING DEVICE 30
13 CHECK PERSONAL INFORMATION

FIG. 4
1 TERMINAL ID
2 PREDETERMINED TIME
3 TOTAL

Figure 5:
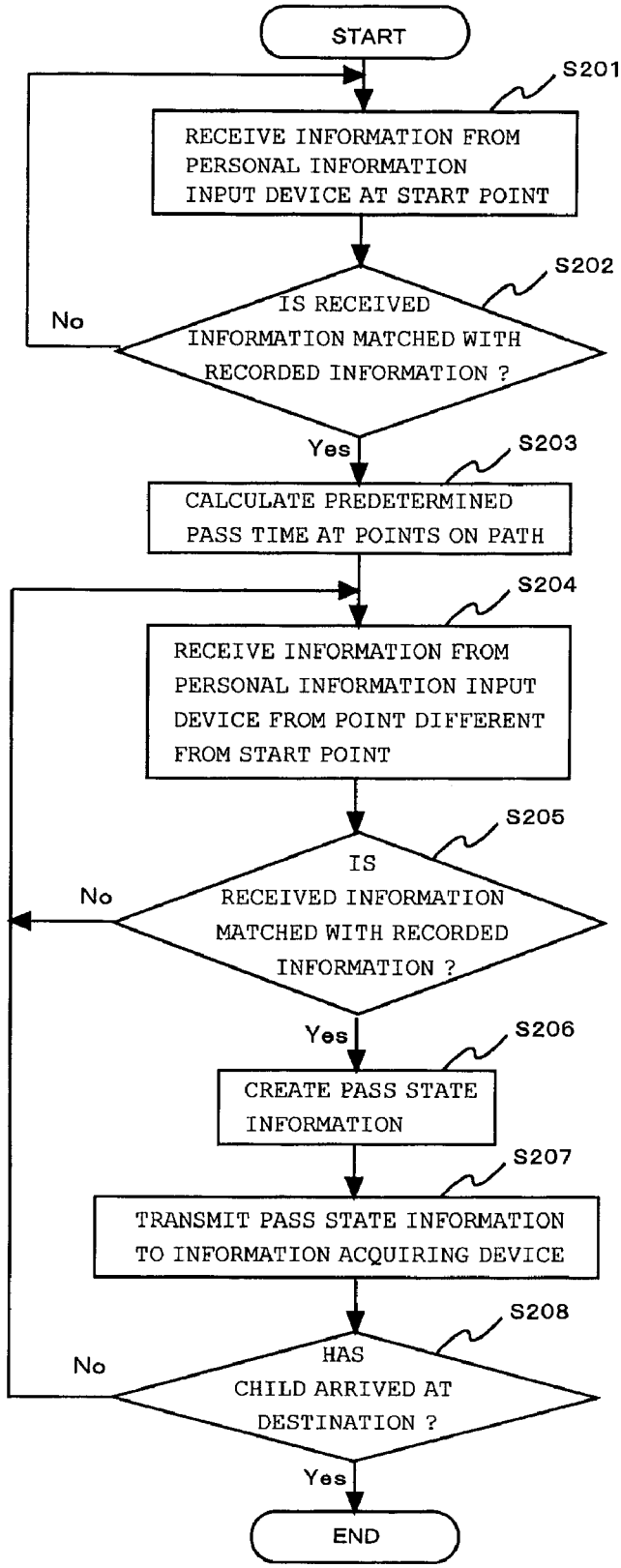
FIG. 5 is a flowchart showing the flow of the notifying operation of the movement state of the child going to and from school.

FIG. 5
1 RECEIVE INFORMATION FROM PERSONAL INFORMATION INPUT DEVICE AT START POINT
2 IS RECEIVED INFORMATION MATCHED WITH RECORDED INFORMATION?
3 CALCULATE PREDETERMINED PASS TIME AT POINTS ON PATH
4 RECEIVE INFORMATION FROM PERSONAL INFORMATION INPUT DEVICE FROM POINT DIFFERENT FROM START POINT
5 IS RECEIVED INFORMATION MATCHED WITH RECORDED INFORMATION?
6 CREATE PASS STATE INFORMATION
7 TRANSMIT PASS STATE INFORMATION TO INFORMATION ACQUIRING DEVICE
8 HAS CHILD ARRIVED AT DESTINATION?

FIG. 6
1 TERMINAL ID
2 PREDETERMINED PASS TIME
3 ACTUAL PASS TIME

Figure 7:
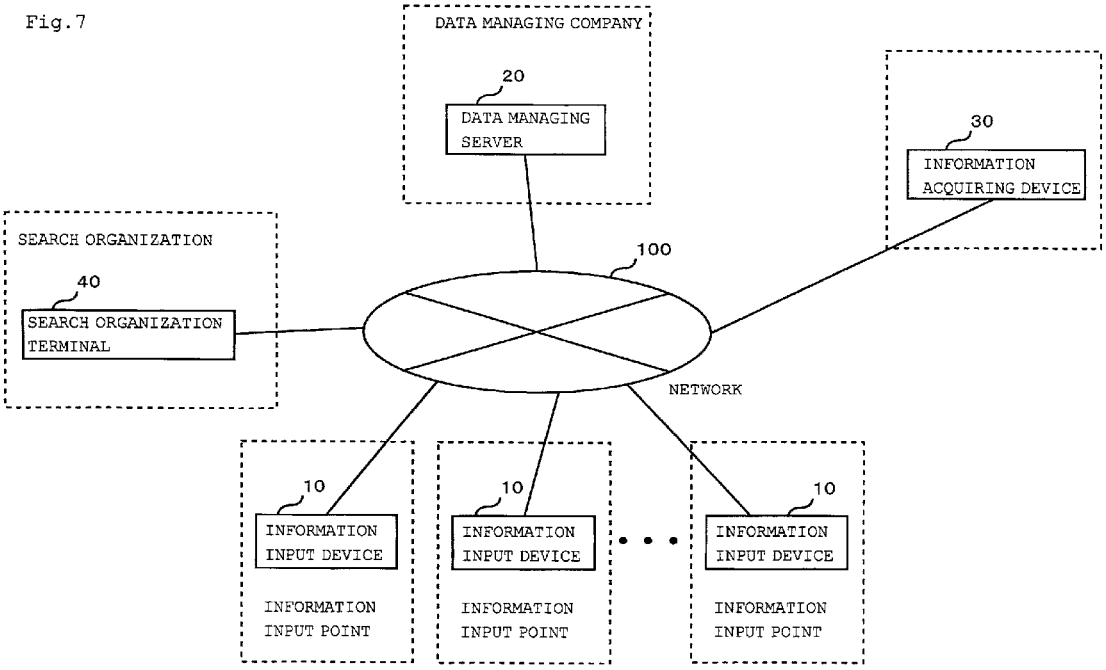
FIG. 7 is a diagram showing the configuration of a movement managing system.

FIG. 7
1 SEARCH ORGANIZATION
2 SEARCH ORGANIZATION TERMINAL
3 DATA MANAGING COMPANY
4 DATA MANAGING SERVER
5 INFORMATION ACQUIRING DEVICE
6 INFORMATION INPUT DEVICE
7 INFORMATION INPUT POINT

Figure 8:
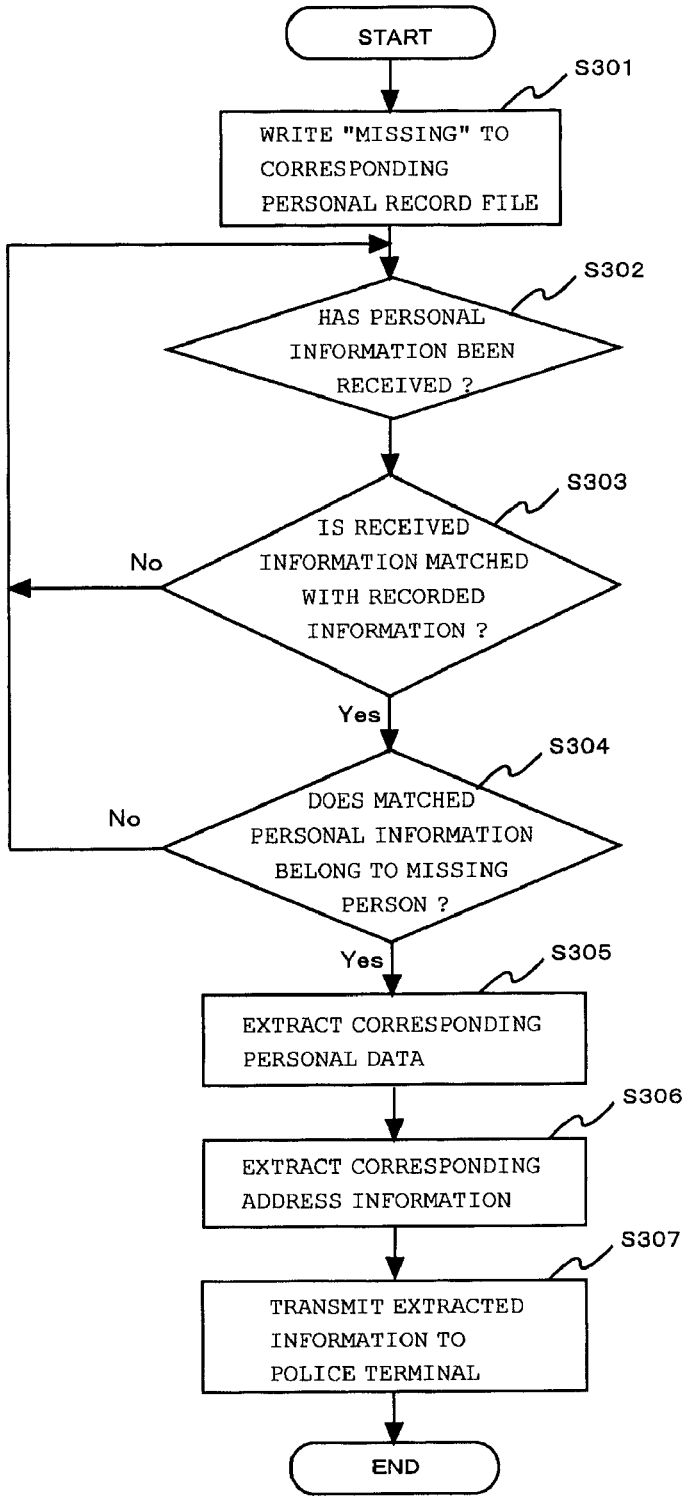
FIG. 8 is a flowchart showing the flow of the searching operation of a missing person according to the movement managing system.
Figure 10:
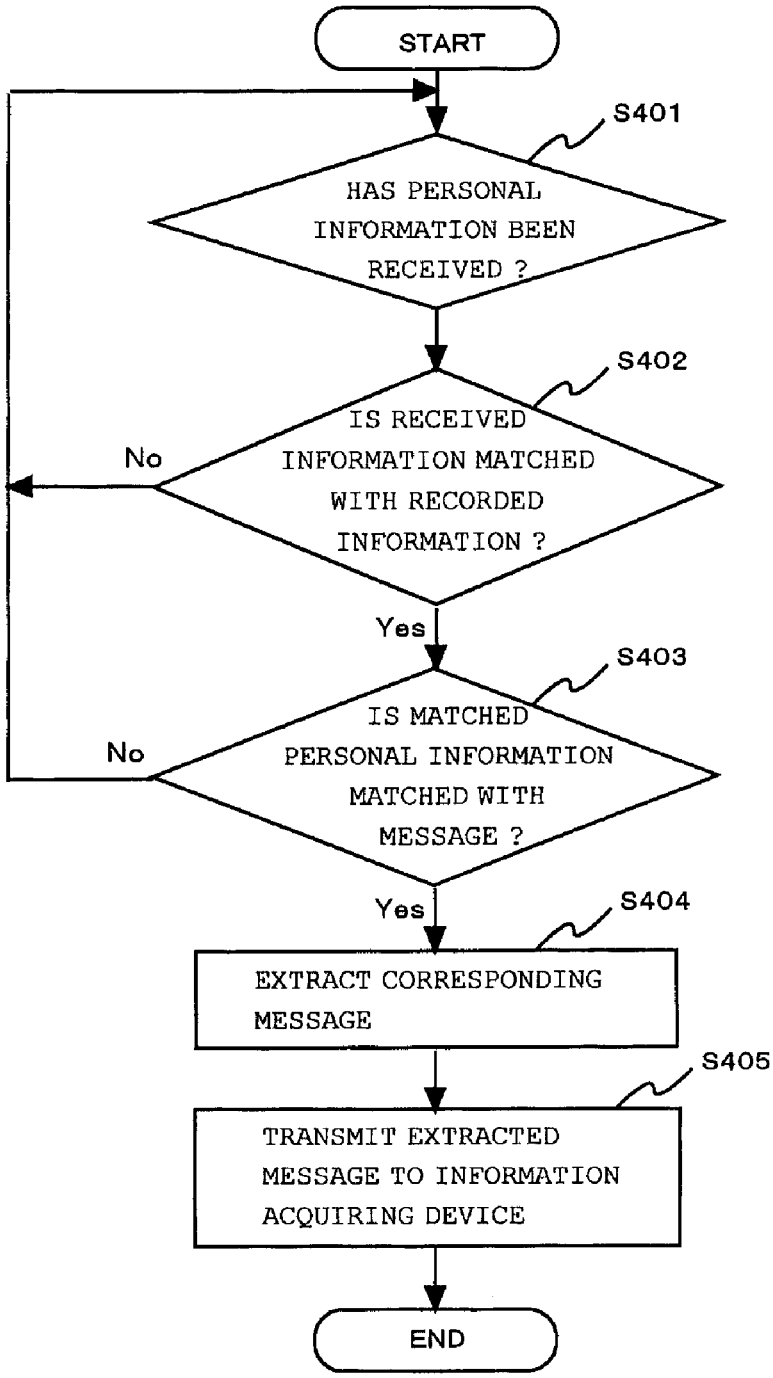
FIG. 10 is a flowchart showing the flow of the transmitting operation of the messages according to the data managing server 20.
Figure 11:
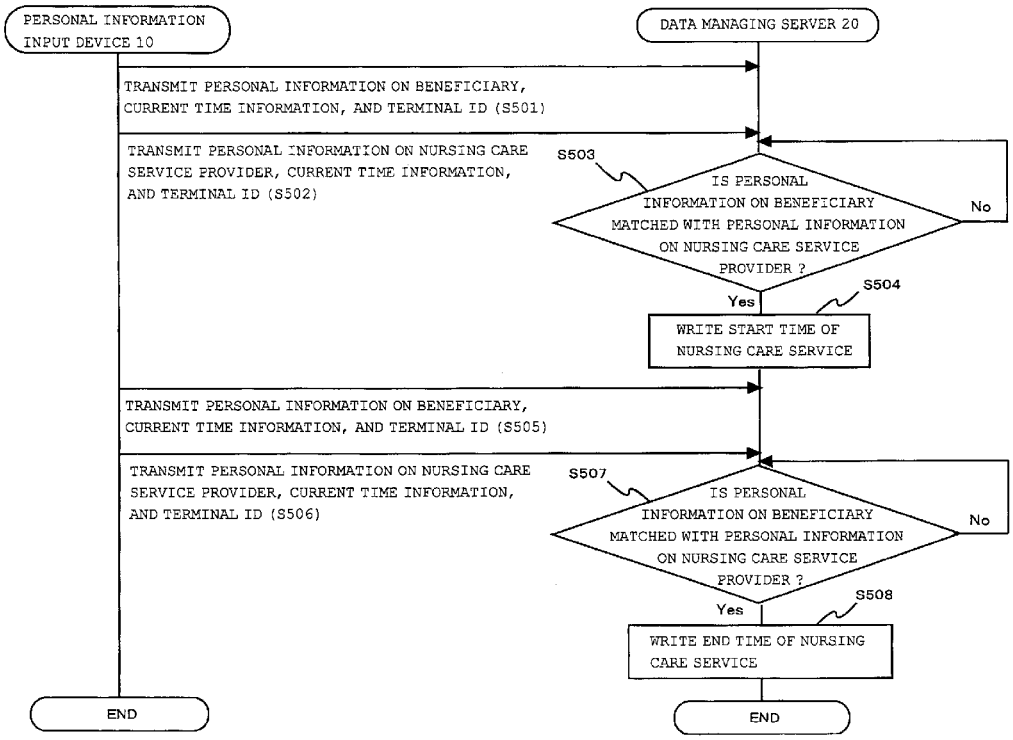
FIG. 11 is a sequence chart showing the flow of the operation according to the movement managing system.
Figure 12:
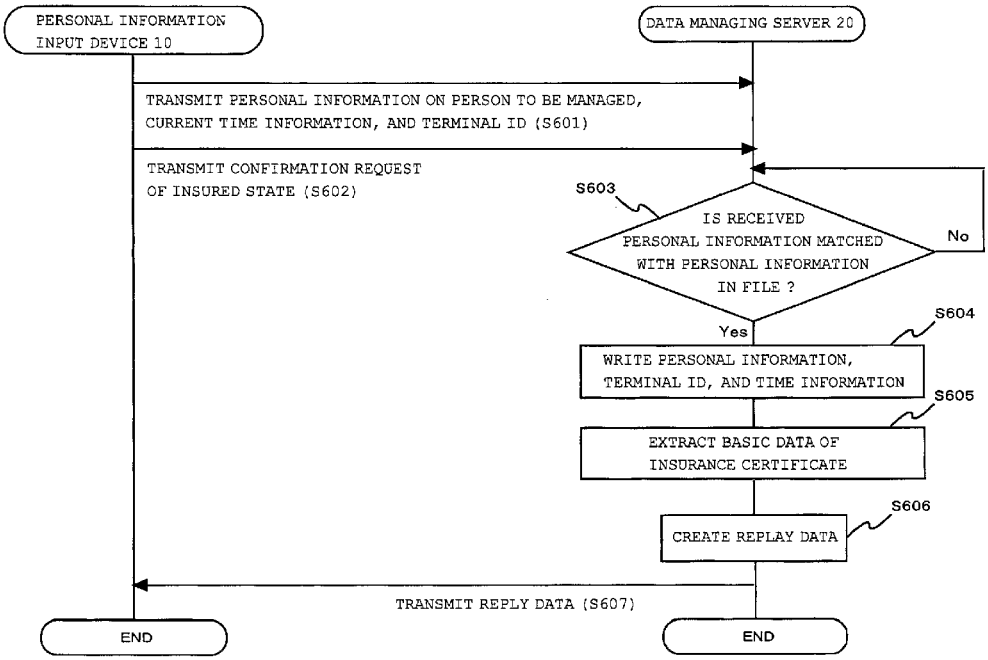
FIG. 12 is a sequence chart showing the flow of the operation according to the movement managing system.
Figure 13:
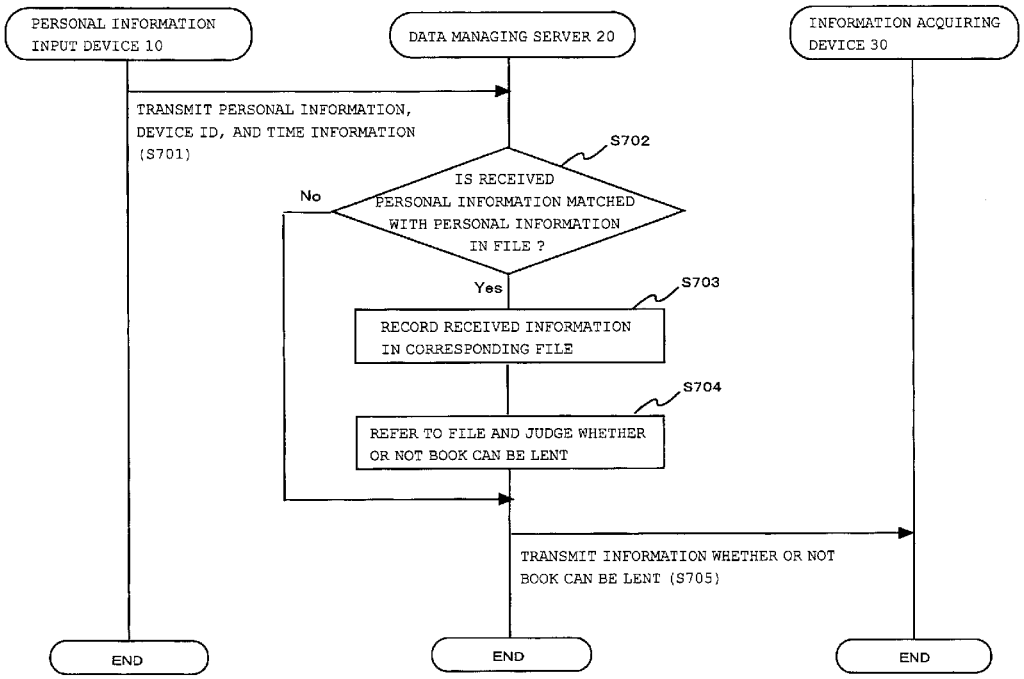
FIG. 13 is a sequence chart showing the flow of the operation according to the movement managing system.
Figure 14:
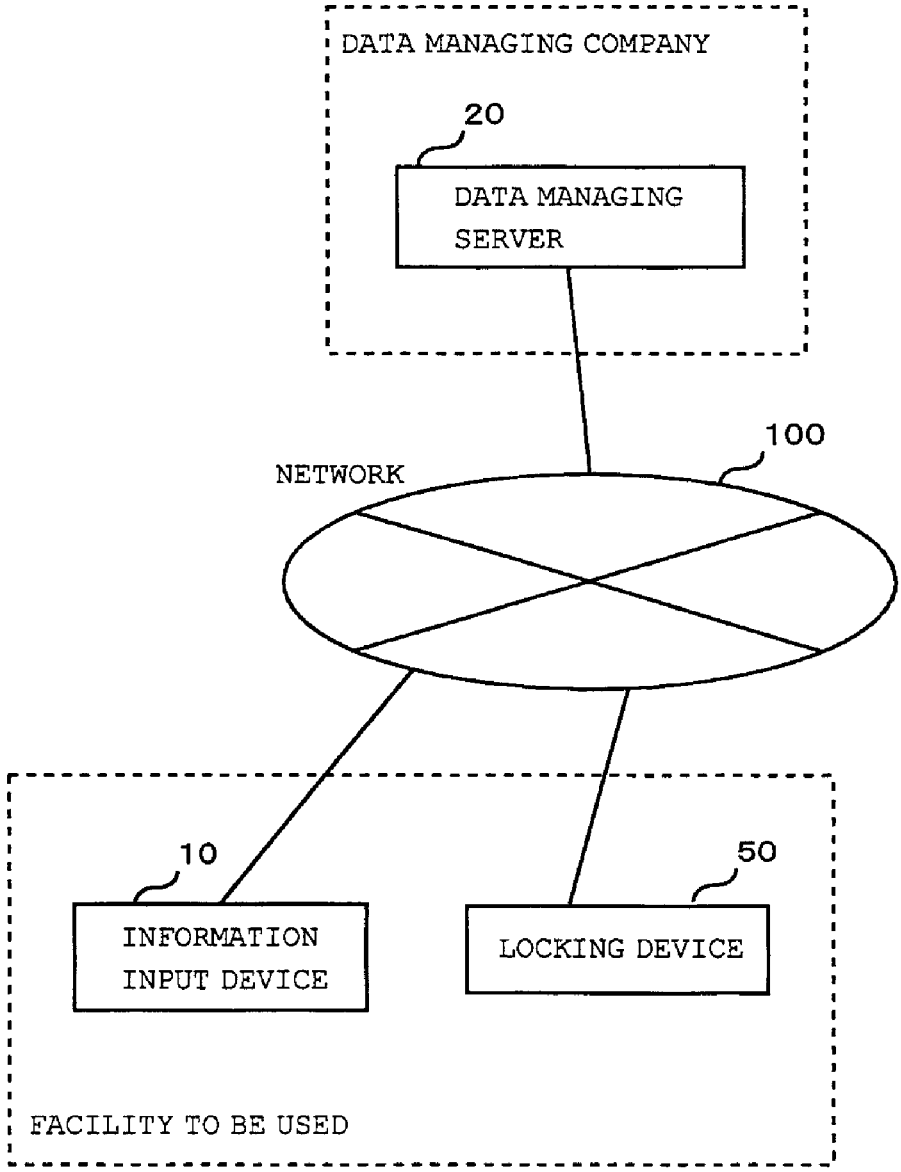
FIG. 14 is a diagram showing the configuration of a movement managing system.
Figure 15:
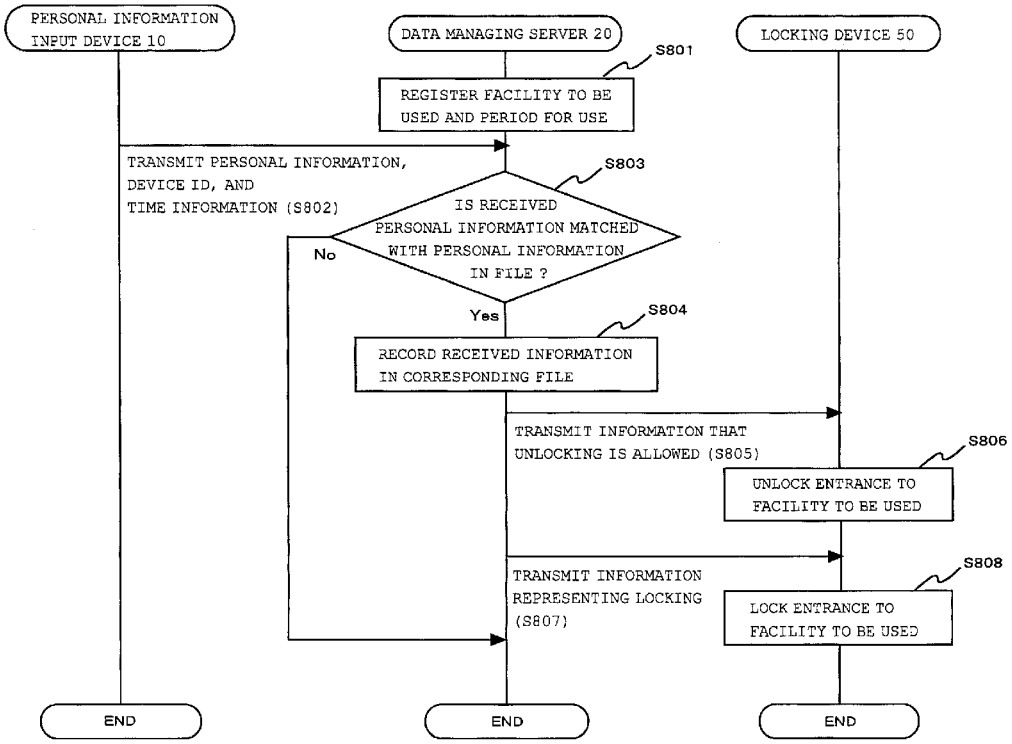
FIG. 15 is a sequence chart showing the flow of the operation according to the movement managing system.

FIG. 8
1 WRITE "MISSING" TO CORRESPONDING PERSONAL RECORD FILE
2 HAS PERSONAL INFORMATION BEEN RECEIVED?
3 IS RECEIVED INFORMATION MATCHED WITH RECORDED INFORMATION?
4 DOES MATCHED PERSONAL INFORMATION BELONG TO MISSING PERSON?
5 Extract Corresponding Personal Data
6 EXTRACT CORRESPONDING ADDRESS INFORMATION
7 TRANSMIT EXTRACTED INFORMATION TO POLICE TERMINAL

FIG. 9

8 BIOMETRICS INFORMATION MESSAGE

9 RIGHT-EYE IRIS

I'LL GO TO FRIEND'S HOME AND THEN COME HOME

10 LEFT-EYE IRIS

I'LL COME HOME LATE FOR CLUB

11 TOUCH CONTINUOUSLY WITH PALM THREE TIMES

I'LL DIRECTLY GO TO JUKU (AFTER-HOURS CRAM SCHOOL)

12 TOUCH CONTINUOUSLY WITH PALM FIVE TIMES

I'LL PLAY AND THEN COME HOME

FIG. 10

1 HAS PERSONAL INFORMATION BEEN RECEIVED?

2 IS RECEIVED INFORMATION MATCHED WITH RECORDED INFORMATION?

3 IS MATCHED PERSONAL INFORMATION MATCHED WITH MESSAGE?

4 Extract Corresponding Message

5 TRANSMIT EXTRACTED MESSAGE TO INFORMATION ACQUIRING DEVICE

FIG. 11

1 PERSONAL INFORMATION INPUT DEVICE 10

2 TRANSMIT PERSONAL INFORMATION ON BENEFICIARY, CURRENT TIME INFORMATION, AND TERMINAL ID (S501)

3 TRANSMIT PERSONAL INFORMATION ON NURSING CARE SERVICE PROVIDER, CURRENT TIME INFORMATION, AND TERMINAL ID (S502)

4 TRANSMIT PERSONAL INFORMATION ON BENEFICIARY, CURRENT TIME INFORMATION, AND TERMINAL ID (S505)

5 TRANSMIT PERSONAL INFORMATION ON NURSING CARE SERVICE PROVIDER, CURRENT TIME INFORMATION, AND TERMINAL ID (S506)

6 END

7 DATA MANAGING SERVER 20

8 IS PERSONAL INFORMATION ON BENEFICIARY MATCHED WITH PERSONAL INFORMATION ON NURSING CARE SERVICE PROVIDER?

9 WRITE START TIME OF NURSING CARE SERVICE

10 IS PERSONAL INFORMATION ON BENEFICIARY MATCHED WITH PERSONAL INFORMATION ON NURSING CARE SERVICE PROVIDER?

11 WRITE END TIME OF NURSING CARE SERVICE

12 END

FIG. 12

1 PERSONAL INFORMATION INPUT DEVICE 10

2 TRANSMIT PERSONAL INFORMATION ON PERSON TO BE MANAGED, CURRENT TIME INFORMATION, AND TERMINAL ID (S601)

3 TRANSMIT CONFIRMATION REQUEST OF INSURED STATE (S602)

4 TRANSMIT REPLY DATA (S607)

5 END

6 DATA MANAGING SERVER 20

7 IS RECEIVED PERSONAL INFORMATION MATCHED WITH PERSONAL INFORMATION IN FILE?

8 WRITE PERSONAL INFORMATION, TERMINAL ID, AND TIME INFORMATION

9 EXTRACT BASIC DATA OF INSURANCE CERTIFICATE

10 CREATE REPLY DATA

11 END

FIG. 13

1 PERSONAL INFORMATION INPUT DEVICE 10

2 TRANSMIT PERSONAL INFORMATION, DEVICE ID, AND TIME INFORMATION (S701)

3 DATA MANAGING SERVER 20

4 IS RECEIVED PERSONAL INFORMATION MATCHED WITH PERSONAL INFORMATION IN FILE?

5 RECORD RECEIVED INFORMATION IN CORRESPONDING FILE

6 REFER TO FILE AND JUDGE WHETHER OR NOT BOOK CAN BE LENT

7 TRANSMIT INFORMATION WHETHER OR NOT BOOK CAN BE LENT (S705)

8 INFORMATION ACQUIRING DEVICE 30

FIG. 14

1 DATA MANAGING COMPANY

2 DATA MANAGING SERVER

3 NETWORK

4 INFORMATION INPUT DEVICE

5 LOCKING DEVICE

6 FACILITY TO BE USED

FIG. 15

1 PERSONAL INFORMATION INPUT DEVICE 10

2 TRANSMIT PERSONAL INFORMATION, DEVICE ID, AND TIME INFORMATION (S802)

3 DATA MANAGING SERVER 20

4 REGISTER FACILITY TO BE USED AND PERIOD FOR USE

5 IS RECEIVED PERSONAL INFORMATION MATCHED WITH PERSONAL INFORMATION IN FILE?

6 RECORD RECEIVED INFORMATION IN CORRESPONDING FILE

7 TRANSMIT INFORMATION THAT UNLOCKING IS ALLOWED (S805)

8 TRANSMIT INFORMATION REPRESENTING LOCKING (S807)

9 LOCKING DEVICE 50

10 UNLOCK ENTRANCE TO FACILITY TO BE USED

11 LOCK ENTRANCE TO FACILITY TO BE USED

FIG. 16

1 DEVICE ID

LATITUDE AND LONGITUDE

ADDRESS

TYPE OF MEANS OF TRANSPORTATION

INSTALLED POSITION OF DEVICE

2 EAST LONGITUDE

NORTH LATITUDE

3 SHINJUKU-KU, TOKYO

4 ○○ RAILWAY

5 ΔΔ BUS

6 xx STATION

7 BUS VEHICLE

8 ▲▲ BUS STOP

FIG. 17

1 INFORMATION ACQUIRING DEVICE 30

2 DISPLAY WHETHER OR NOT MEANS OF TRANSPORTATION CAN BE USED

3 PERSONAL INFORMATION INPUT DEVICE 10 AT HOME

4 PERSONAL INFORMATION INPUT DEVICE 10 IN MEANS OF TRANSPORTATION

5 TRANSMIT PERSONAL INFORMATION, DEVICE ID, AND TIME INFORMATION (S901)

6 TRANSMIT PERSONAL INFORMATION, DEVICE ID, AND TIME INFORMATION (S904)

7 TRANSMIT JUDGED RESULT WHETHER OR NOT MEANS OF TRANSPORTATION CAN BE USED (S908)
8 DATA MANAGING SERVER 20
9 IS RECEIVED PERSONAL INFORMATION MATCHED WITH PERSONAL INFORMATION IN FILE?
10 RECORD RECEIVED INFORMATION IN CORRESPONDING FILE
11 IS RECEIVED PERSONAL INFORMATION MATCHED WITH PERSONAL INFORMATION IN FILE?
12 RECORD RECEIVED INFORMATION IN CORRESPONDING FILE
13 JUDGE WHETHER OR NOT MEANS OF TRANSPORTATION CAN BE USED

The invention claimed is:

1. A movement managing system for managing the movement of a person to be managed comprising personal information input devices installed in plural specified positions and inputting personal information on the person, a data managing server for managing information on the person, and an information acquiring device for acquiring information on the person from the data managing server, wherein when personal information for specifying the person is inputted, the personal information input device transmits the personal information and the device ID that the device uniquely has to the data managing server, the data managing server identifies the pass position on the movement path that the person has passed on the basis of the personal information and device ID received from the personal information input device, and transmits the identified information to the information acquiring device, and the data managing server stores a table representing position information corresponding to the personal information, receives the personal information and the device ID from the personal information input device, refers to the table representing the position information to convert the received personal information to information representing the movement destination of the person to be managed, identifies the current position of the person from the device ID, and estimates the movement path of the person from the movement destination and the current position.

2. The movement managing system according to claim 1, wherein the data managing server previously stores the personal information, checks the stored personal information with the received personal information, and identifies the person to be managed.

3. The movement managing system according to claim 1, wherein the data managing server receives personal information on the person to be managed from the personal information input device in the position out of a predetermined movement path of the person previously stored in itself, and transmits information that the person is moving out of the estimated movement path to the information acquiring device.

4. The movement managing system according to claim 1, wherein the data managing server stores a table representing message information corresponding to the personal information, receives the personal information from the personal information input device, refers to the table representing the message information to convert the received personal information to the message information, and transmits the converted message information to the information acquiring device.

5. The movement managing system according to claim 4, wherein the data managing server creates the message information on the basis of one of the type, the number of receptions, and the reception interval of personal information received from the personal information input device or a combination of these, and transmits the created message information to the information acquiring device.

6. The movement managing system according to claim 1, wherein the data managing server stores a table representing the correspondence of the device ID and the installed position of the personal information input device, and identifies the installed position corresponding to the received device ID as the pass position on the movement path.

7. The movement managing system according claim 1, wherein the personal information input device transmits time information representing a time in which the personal information is inputted to the data managing server together with the personal information and the device ID, wherein the data managing server transmits the time information received from the personal information input device as a time in which the person has passed the installed position of the personal information input device to the information acquiring device together with information representing the pass position.

8. The movement managing system according to claim 7, wherein the data managing server stores a predetermined movement time information representing a time required for the person to be managed to move on the movement path, estimates a pass time or arrival time on the movement path that the person to be managed has passed using the predetermined movement time information, and transmits information representing the estimated time to the information acquiring device together with information representing time in which the person has actually passed or arrived.

9. The movement managing system according to claim 8, wherein the data managing server transmits information that the person to be managed has not passed or arrived to the information acquiring device when the pass or arrival estimated time has elapsed while the person has not passed or arrived.

10. The movement managing system according to claim 1, wherein the data managing server receives personal information on the person to be managed from the personal information input device out of the estimated movement path, and transmits information that the person is moving out of the estimated movement path to the information acquiring device.

11. The movement managing system according to claim 1, wherein when a fixed time or more has elapsed since personal information on the same person to be managed has not been received from the personal information input device, the data managing server transmits information that an abnormality is caused to the input of the personal information to the information acquiring device.

12. The movement managing system according to claim 1, wherein the data managing server continuously receives personal information on the same person to be managed from the personal information input device over a predetermined number of times within a predetermined time, and transmits information that an abnormality is caused to the input of the personal information to the information acquiring device.

13. The movement managing system according to claim 1, wherein the data managing server transmits age information on the person to be managed identified on the basis of personal information received from the personal information input device to the information acquiring device.

14. The movement managing system according to claim 1, wherein the data managing server judges whether or not a person identified by the personal information can enter a predetermined facility on the basis of personal information received from the personal information input device, and transmits information representing the judged result whether or not the person can enter the facility to the personal information input device, wherein the personal information input device controls unlocking and locking of the entrance to the predetermined facility on the basis of the judged result whether or not the person can enter the facility received from the data managing server.

15. The movement managing system according to claim 1, wherein the person to be managed is a child going to and from school, wherein plural personal information input devices are installed in the school zone.

16. The movement managing system according to claim 14, wherein the person to be managed is an elderly person, wherein one or more personal information input devices are installed in the home of the elderly person.

17. The movement managing system according to claim 1, wherein the person to be managed is a missing person, wherein the movement managing system further has a search organization terminal operated by a search organization searching for the person to be managed, wherein the data managing server transmits information representing the installed position of the personal information input device on the transmitting side to the search organization terminal when the person to be managed identified on the basis of personal information received from the personal information input device is registered as a missing person.

18. The movement managing system according to claim 1, wherein the person to be managed is a beneficiary receiving a service and a service provider providing the service to the beneficiary, wherein the data managing server judges that the beneficiary and the service provider identified by personal information received from the personal information input device are in the service use-provision relation, and records that the service provision by the service provider has started or ended in itself, upon reception of personal information on the both.

19. The movement managing system according to claim 1, wherein the person to be managed is a beneficiary receiving a nursing care service and a nursing care service provider providing a nursing care service to the beneficiary, wherein the data managing server judges that the beneficiary and the nursing care service provider identified by personal information received from the personal information input device are in the nursing care service use-provision relation, and records that the nursing care service provision by the nursing care service provider has started or ended in itself, upon reception of personal information on the both.

20. The movement managing system according to claim 1, wherein the data managing server transmits information on the identification card of the person to be managed identified on the basis of personal information received from the personal information input device to the information acquiring device.

21. The movement managing system according to claim 20, wherein information on the identification card is information on a car license, passport, residents' basic register card, employee identification card, and student identification card.

22. The movement managing system according to claim 1, wherein the person to be managed is an insured person, wherein the personal information input device is installed in a medical facility, and when personal information on the person to be managed is inputted, transmits the inputted personal information to the data managing server, wherein the data managing server judges that a person identified by personal information received from the personal information input device is an insured person of an insurance available in the medical facility, and transmits information on the insured person previously stored in itself so as to be matched with the personal information to the information acquiring device installed in the medical facility.

23. The movement managing system according to claim 1, wherein the person to be managed is a user of a book lending service in a library, wherein the personal information input device is installed in the library and when personal information on the person to be managed is inputted, transmits the inputted personal information to the data managing server, wherein the data managing server judges that the person identified by the personal information received from the personal information input device can borrow a book from the library and transmits the information that the book can be lent to the information acquiring device in installed in the library.

24. The movement managing system according to claim 1, wherein the data managing server stores information representing a means of transportation available by the person to be managed, judges whether or not the person identified on the basis of personal information received from the personal information input device can use the means of transportation in which the personal information input device on the transmitting side is installed, and transmits the judged result to the information acquiring device installed in the means of transportation.

25. The movement managing system according to claim 1, wherein the person to be managed is a person receiving free-of-charge/discount application for an elderly person using a means of transportation, wherein the personal information input device is installed at the boarding gate or the ticket gate of the means of transportation provided by the public transport and when personal information on the person to be managed is inputted, transmits the personal information to the data managing server, wherein the data managing server stores the personal information so as to be matched with information representing whether or not free-of-charge/discount can be applied, refers to the stored information to judge whether or not the person identified by the personal information received from the personal information input device is a person having a qualification for free-of-charge/discount application, and transmits information representing the judged result to the information acquiring device.

26. The movement managing system according to claim 1, wherein the personal information is biometrics information on the person to be managed.

* * * * *